US006520700B1

(12) United States Patent
Iwata

(10) Patent No.: US 6,520,700 B1
(45) Date of Patent: Feb. 18, 2003

(54) RECORDING APPARATUS

(75) Inventor: Kazuya Iwata, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 195 days.

(21) Appl. No.: 09/746,163

(22) Filed: Dec. 26, 2000

(30) Foreign Application Priority Data

Dec. 28, 1999 (JP) ..... 11-373846

(51) Int. Cl.[7] ..... B41J 11/42; B41J 13/08
(52) U.S. Cl. ..... 400/582; 400/624; 400/636
(58) Field of Search ..... 400/582, 578, 400/636, 624

(56) References Cited

U.S. PATENT DOCUMENTS

| | | | | |
|---|---|---|---|---|
| 4,313,124 A | | 1/1982 | Hara | |
| 4,345,262 A | | 8/1982 | Shirato et al. | |
| 4,459,600 A | | 7/1984 | Sato et al. | |
| 4,463,359 A | | 7/1984 | Ayata et al. | |
| 4,558,333 A | | 12/1985 | Sugitani et al. | |
| 4,608,577 A | | 8/1986 | Hori | |
| 4,723,129 A | | 2/1988 | Endo et al. | |
| 4,740,796 A | | 4/1988 | Endo et al. | |
| 5,529,414 A | * | 6/1996 | Katano et al. | 271/266 |
| 5,853,256 A | * | 12/1998 | Kim | 400/624 |
| 6,116,795 A | * | 9/2000 | Ogasawara | 271/266 |
| 6,126,345 A | * | 10/2000 | Ito et al. | 400/283 |
| 6,126,346 A | * | 10/2000 | Hibino et al. | 400/636 |

FOREIGN PATENT DOCUMENTS

| | | | | |
|---|---|---|---|---|
| EP | 0680829 A2 * | 11/1995 | | B41J/13/00 |
| EP | 0 680 829 | 11/1995 | | |
| EP | 0 760 289 | 3/1997 | | |
| EP | 0760289 A2 * | 3/1997 | | B41J/2/205 |
| JP | 54-56847 | 5/1979 | | |
| JP | 59-123670 | 7/1984 | | |
| JP | 59-138461 | 8/1984 | | |
| JP | 60-71260 | 4/1985 | | |

* cited by examiner

*Primary Examiner*—Andrew H. Hirshfeld
*Assistant Examiner*—Charles H. Nolan, Jr.
(74) *Attorney, Agent, or Firm*—Fitzpatrick, Cella, Harper & Scinto

(57) ABSTRACT

A recording apparatus for performing recording onto a recording medium includes a transporting device for transporting the receding medium, the transporting device including a combination of driving elements including a transporting motor and a transporting roller and set so that, upon completion of a turn of the transporting roller, the other driving elements are reset to an initial state, a detecting section, arranged on the transporting roller, showing a reference position of the transporting roller, a reference position detector detecting the detecting section and outputting a detection signal, a rotation angle measuring device, being detachably attached to the transporting roller, for measuring a rotation angle of the transporting roller, a storage unit for previously storing a number of driving pulses corrected so that the amount of transportation generated by the transporting roller is kept constant, on the basis of information from the rotation angle measuring device for a turn of the transporting roller, and a controller driving-controlling the transporting motor on the basis of the corrected number of driving pulses store in the storage unit.

24 Claims, 27 Drawing Sheets

FIG. 11

| | TRANSPORTING MOTOR GEAR | LARGE GEAR OF SLOWDOWN GEAR | SMALL GEAR OF SLOWDOWN GEAR | TRANSPORTING GEAR |
|---|---|---|---|---|
| MODULE | 0.6 | 0.6 | 0.4 | 0.4 |
| NUMBER OF TEETH | 20 | 60 | 20 | 160 |
| RADIUS OF REFERENCE PITCH CIRCLE (mm) | 6 | 18 | 4 | 32 |
| GEAR CLASS | JGMA CLASS 3 | JGMA CLASS 3 (JGMA CLASS 1) | JGMA CLASS 3 (JGMA CLASS 1) | JGMA CLASS 3 (JGMA CLASS 1) |
| MARGIN OF ERROR IN MESHING FOR ONE PITCH (μm) | 13 | 16 | 13 | 16 |
| RATIO TO RADIUS | 0.217% | 0.089% | 0.325% | 0.050% |
| MARGIN OF ERROR IN MESHING FOR FULL PITCH (μm) | 45 | 53 | 22 | 56 |
| RATIO TO RADIUS | 0.750% | 0.294% | 1.125% | 1.175% |

| | |
|---|---|
| MARGIN OF ERROR IN STOPPING ANGLE OF TRANSPORTING MOTOR | ±5% OF ADJACENT 7.5° |

| | TRANSPORTING ROLLER | |
|---|---|---|
| DIAMETER | 12.936 | mm |
| RADIUS | 6.468 | mm |
| AMOUNT OF DEVIATION | 20 (10) | μm |
| RATIO TO RADIUS | 0.309% | |
| | | |
| | | |
| MARGIN OF ERROR FOR DIAMETER | ±20(±10) | μm |
| MARGIN OF ERROR FOR RADIUS | ±10(±5) | μm |

| | | | | |
|---|---|---|---|---|
| OUTER DIAMETER OF TRANSPORTING ROLLER | 12.936 | mm | | |
| REDUCTION RATIO | 0.0417 | | (= 1/24) | REDUCTION IN TWO STEPS |
| | | | | |
| NUMBER OF MOTOR STEPS | 48 | | | |
| AMOUNT OF PAPER FEED PER STEP | 0.0353 | mm | (=1/720inch) | |
| | | | | |
| HEAD RESOLUTION | 720 | dpi | | |
| NUMBER OF BLACK NOZZLES | 160 | NOZZLES | 5.64444444 | mm |
| NUMBER OF COLOR NOZZLES | 160 | NOZZLES | 5.64444444 | mm |
| | | | | |
| NUMBER OF PASSES FOR FINE PRINTING | 4 | PASSES | | |
| PRINTING RESOLUTION | 720 | dpi | | |
| AMOUNT OF LINE FEED | 40/720 | inch | 1.41111111 | mm |

CALCULATED VALUES OF MARGIN OF ERROR IN PAPER FEED AMOUNT WITHOUT CORRECTION
(COMPARATIVE EXAMPLE)

MARGIN OF ERROR IN PAPER FEED AT TIME OF 40/720 INCH LINE FEED PITCH WITHOUT CORRECTION (COMPARATIVE EXAMPLE)

MARGIN OF ERROR IN PAPER FEED PITCH AT TIME OF 40/720 INCH × 4 LINE FEED WITHOUT CORRECTION (COMPARATIVE EXAMPLE)

MARGIN OF ERROR IN PAPER FEED PITCH AT THE TIME OF 40/720 INCH LINE FEED WITH CORRECTION

FIG. 24

| | TRANSPORTING MOTOR GEAR | LARGE GEAR OF SLOWDOWN GEAR | SMALL GEAR OF SLOWDOWN GEAR | TRANSPORTING GEAR |
|---|---|---|---|---|
| MODULE | 0.6 | 0.6 | 0.4 | 0.4 |
| NUMBER OF TEETH | 20 | 60 | 20 | 160 |
| RADIUS OF REFERENCE PITCH CIRCLE (mm) | 6 | 18 | 4 | 32 |
| GEAR CLASS | JGMA CLASS 3 | JGMA CLASS 1 | JGMA CLASS 1 | JGMA CLASS 1 |
| MARGIN OF ERROR IN MESHING FOR ONE PITCH (μm) | 13 | 8.5 | 7.1 | 9 |
| RATIO TO RADIUS | 0.217% | 0.047% | 0.178% | 0.028% |
| MARGIN OF ERROR IN MESHING FOR FULL PITCH (μm) | 45 | 28 | 22 | 28 |
| RATIO TO RADIUS | 0.750% | 0.156% | 0.550% | 0.088% |

| | |
|---|---|
| MARGIN OF ERROR IN STOPPING ANGLE OF TRANSPORTING MOTOR | ±5% OF ADJACENT 7.5° |

| | TRANSPORTING ROLLER | |
|---|---|---|
| DIAMETER | 10.78 | mm |
| RADIUS | 5.39 | mm |
| AMOUNT OF DEVIATION | 10 | μm |
| RATIO TO RADIUS | 0.186% | |
| | | |
| | | |
| MARGIN OF ERROR FOR DIAMETER | ±10 | μm |
| MARGIN OF ERROR FOR RADIUS | ±5 | μm |

| | | | | |
|---|---|---|---|---|
| OUTER DIAMETER OF TRANSPORTING ROLLER | 10.78 | mm | | |
| REDUCTION RATIO | 0.0417 | | (= 1/24) | REDUCTION IN TWO STEPS |
| | | | | |
| NUMBER OF MOTOR STEPS | 48 | | | |
| AMOUNT OF PAPER FEED PER STEP | 0.0294 | mm | (=1/864inch) | |
| | | | | |
| HEAD RESOLUTION | 720 | dpi | | |
| NUMBER OF BLACK NOZZLES | 160 | NOZZLES | 5.64444444 | mm |
| NUMBER OF COLOR NOZZLES | 160 | NOZZLES | 5.64444444 | mm |
| | | | | |
| NUMBER OF PASSES FOR FINE PRINTING | 4 | PASSES | | |
| PRINTING RESOLUTION | 720 | dpi | | |
| AMOUNT OF LINE FEED | 40/720 | inch | 1.41111111 | mm |

CALCULATED VALUES OF MARGIN OF ERROR IN PAPER FEED AMOUNT WITH CONVENTIONAL ARRANGEMENT

MARGIN OF ERROR IN PAPER FEED PITCH AT TIME OF 40/720 INCH LINE FEED WITH CONVENTIONAL ARRANGEMENT

MARGIN OF ERROR IN PAPER FEED PITCH AT TIME OF 40/720 INCH × 4 LINE FEED WITH CONVENTIONAL ARRANGEMENT

RECORDING APPARATUS

BACKGROUND OF THE INVENTION

1. Field of the Invention

The present invention relates to a recording apparatus. More particularly, the invention relates to a recording apparatus used in information processing devices such as a printer, a copying machine, a wordprocessor and a computer.

2. Description of the Related Art

A recording apparatus is known in which a plurality of recording elements such as discharge elements comprising ink discharge ports capable of individually discharging ink droplets, liquid paths and a discharge energy generating element are provided on a recording head at a prescribed fine density to perform recording, corresponding to an arrangement length of the discharge ports, on a recording medium, by means of ink droplets selectively discharged from the ink discharge ports while such a recording head is moved on a carriage in a main scanning direction, and the recording is accomplished by repeating sheet feeding of the recording medium in a sub-scanning direction perpendicular to the main scanning direction.

Recent improvements in the image quality of color ink-jet recorders are remarkable, and further improvement of the image quality to a level known as "photo-image quality" is now demanded. For the purpose of improving the image quality, there is also an increasing requirement for achieving a higher resolution: while the resolution in the paper feed direction was about 360 dots per inch (dpi) a few years ago, products having a resolution of even 720 dpi are now commercially available.

The distance between adjacent dots, which was 70.6 μm with a resolution of 360 dpi (=25.4 mm/360) is now reduced to 35.2 μm at a resolution of 720 dpi (=25.4 mm/720). In the ink-jet recording method of expressing colors by feeding ink droplets of different colors within a prescribed area, the performance required for the paper feed accuracy is now as high as a "micron order".

Three methods for improving the line feed accuracy in the paper feed mechanism in a conventional recording apparatus will now be described.

A first method disclosed in published European Patent document No. 0 680 829 comprises the steps of attaching a rotary encoder on a transporting roller shaft and feeding back information available therefrom, thereby improving the stop position control accuracy.

A second method disclosed in U.S. Pat. No. 5,529,414 comprises the steps of setting the outer periphery length of a transporting roller to N-times a basic amount of line feed, providing a reference position detector for detecting a paper feed starting position of the transporting roller, previously storing correction values for N line feeds corresponding to the amount of eccentricity of the transporting roller, and, when starting paper feed, starting it at the paper feed starting position of the transporting roller without fail.

A third method disclosed in published European Patent document No. 0 760 289 comprises the steps of improving the accuracy of parts related with the paper feed accuracy, and then making adjustments so that the parts accuracy of some parts does not affect the line feed accuracy.

The third method will be described further in detail as being conventional in the art.

FIG. 23 is a perspective view of a transporting mechanism of a typical conventional recording apparatus.

A transporting motor 209, which is a stepping motor, is used as a driving source, and the mechanism has a slow-down gear 210, which is a double gear, and a transporting roller gear 215 directly connected to a transporting roller 211.

FIG. 24 shows a mechanical accuracy table of the transporting mechanism of the conventional recording apparatus. The recording head has a resolution of 720 dpi and has 160 nozzles for each color. Because fine printing is recorded with four passes, the basic amount of line feed would be 40/720-inches or 1/18 of an inch. The reduction ratio from a transporting motor gear 216 directly connected to the transporting motor 209 to the transporting roller gear 215 is 1/24, which is achieved through two stages of 1/3 and 1/8. In this configuration, when the outside diameter of the transporting roller 211 is adjusted, and the transporting motor gear 216 makes a turn, the transporting roller 211 feeds a basic amount of line feed of 1/18 of an inch.

In the above-mentioned configuration, adjustments are made so that an engagement error of the transporting motor gear 216 or a stop angle error of the transporting motor 209 does not affect the amount of line feed. JGMA class 1 is selected for the slow-down gear 210 and the transporting roller gear 215, and a tolerable error of ±10 μm is set for the diameter of the transporting roller 211, and 10 μm for a tolerable deviation.

FIG. 25 is a graph showing calculated values of an error of the paper feed amount in a conventional recording apparatus. The calculation is based on the worst value of the tolerable error of the parts accuracy. Even the largest value is within a range of error of under 10 μm. While this graph contains errors caused by a deviation of the transporting roller 211, an increase or decrease in an average amount of paper feed caused by diameter errors is not included. The calculation is based on the assumption that the average feed amount is an ideal.

FIG. 26 is a graph showing paper feed pitch errors upon a 1/18 of an inch feed of the conventional recording apparatus. An average increase in the feed amount caused by a diameter error of the transporting roller 211 is contained. A calculation is made on the assumption of a maximum value of a tolerable diameter error of +10 μm, and an average increase in paper feed amount expected with a feed of 1/18 of an inch +1.31 μm is added. As a result, the paper feed pitch error is limited to under 6 μm with a feed of 1/18 of an inch.

FIG. 27 is a graph showing a paper feed pitch error upon a line feed of 1/18 of an inch×4 in the conventional recording apparatus. In four printing, because the shift of the ink hitting position from printing after four line feeds is a point at issue, this value is important. There is contained an average increase in the feed amount caused by a diameter error of the transporting roller 211. A calculation is performed on the assumption of a maximum value of a tolerable diameter error of +10 μm and there is added an average increase in paper feed amount expected with 1/18 of an inch×4 lines +5.24 μm. As a result, it is expected that a paper feed pitch error of about 16 μm would be caused with 1/18 of an inch four line feeds.

The conventional recording apparatus has, however, the following problems.

In the first conventional case, the line feed pitch error caused by the amount of transporting roller deviation has not as yet been solved. It is necessary to provide a rotary encoder for each apparatus, thus leading to an increase in cost.

In the second conventional case, the error in stop angle of the transporting motor, and a line feed pitch error caused by engagement error of the transporting motor gear, the slow-down gear, the transporting roller gear and the transporting roller have not as yet been solved. At the start of paper feed, it is necessary to bring the transporting roller back to the starting reference position, and this leads to more complicated control and a disadvantage in improving the recording rate.

In the third conventional case, a higher accuracy is demanded for the slow-down gear, the transporting gear and the transporting roller, resulting in an increase in cost.

SUMMARY OF THE INVENTION

An object of the present invention is to provide a recording apparatus permitting improvement of the recording paper line feed pitch accuracy without an increase in cost.

Another object of the invention is to provide a recording apparatus for performing recording onto a recording medium by recording means. The recording apparatus includes transporting means for transporting the recording medium, the transporting means comprising a combination of driving elements including a transporting motor and a transporting roller set so that the other driving elements are reset to an initial state upon completion of a turn of the transporting roller, a detecting section, arranged on the transporting roller, showing a reference position of the transporting roller, a reference position detector detecting the detecting section and outputting a detection signal, a rotation angle measuring device, being detachably attached to the transporting roller, for measuring a rotation angle of the transporting roller, a storage unit previously storing a number of driving pulses for a turn of the transporting roller, corrected so as to provide a constant amount of transportation of the transporting roller, on the basis of information from the rotation angle measuring device for a turn of the transporting roller, and a controller driving-controlling the transporting motor on the basis of the corrected number of driving pulses stored in the storage unit.

It is also an object of the invention to provide such a recording apparatus further comprising a surface height measuring device, being detachably attached to the transporting roller, for measuring a surface height of the transporting roller. In this case, the storage unit previously stores a number of driving pulses for a turn of the transporting roller, corrected so as to provide a constant amount of rotation of the transporting roller, on the basis of information from the rotation angle measuring device and the surface height measuring device and the controller driving-controls the transporting motor, on the basis of the corrected number of driving pulses stored in the storage unit.

It is yet another object of the invention to provide a recording apparatus for performing recording onto a recording medium by recording means. The apparatus includes transporting means for transporting the recording medium, the transporting means comprising a combination of driving elements including a transporting motor and a transporting roller, set so that the other driving elements are reset to an initial state upon completion of a turn of the transporting roller, a detecting section, arranged on the transporting roller, showing a reference position of the transporting roller, a reference position detector detecting the detecting section and outputting a detection signal, a rotation angle measuring device attaching/detaching section, arranged on the transporting roller and being capable of attaching/detaching a rotation angle measuring device, the rotation angle measuring device measuring a rotation angle of the transporting roller, a storage unit previously storing the number of driving pulses for a turn of the transporting roller, corrected so as to provide a constant amount of transportation of the transporting roller, on the basis of information from the rotation angle measuring device, and a controller driving-controlling the transporting motor on the basis of the corrected number of driving pulses stored in the storage unit.

It is a further object of the invention to provide such a recording apparatus further comprising a surface height measuring device attaching/detaching section, arranged on the transporting roller and being capable of attaching/detaching a surface height measuring device, the surface height measuring device measuring the surface height of the transporting roller. In this case, the storage unit previously stores a number of driving pulses for a turn of the transporting roller, corrected so as to provide a constant amount of transportation of the transporting roller, on the basis of information from the rotation angle measuring device and the surface height measuring device, and the controller driving-controls the transporting motor on the basis of the corrected number of driving pulses stored in the storage unit.

Further objects, features and advantages of the present invention will become apparent from the following description of the preferred embodiments (with reference to the attached drawings).

BRIEF DESCRIPTION OF THE DRAWINGS

FIG. 5C shows an enlarged one of six nozzle trains.

FIG. 11 is a mechanical accuracy table of a transporting mechanism of a recording apparatus of an embodiment of the invention;

FIG. 24 is a mechanical accuracy table of a transporting mechanism of a conventional recording apparatus;

DESCRIPTION OF THE PREFERRED EMBODIMENTS

Embodiments of the present invention will now be described with reference to the drawings.

<First Embodiment>

Figure 1:
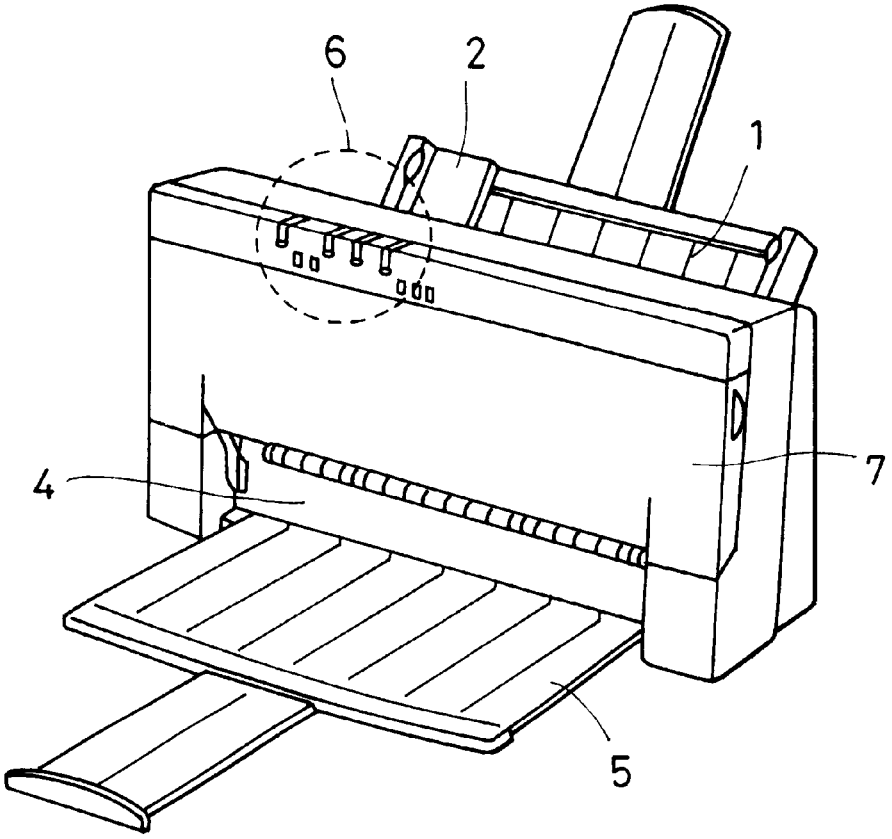
FIG. 1 is an exterior perspective view of a recording apparatus of an embodiment of the present invention.
Figure 2:
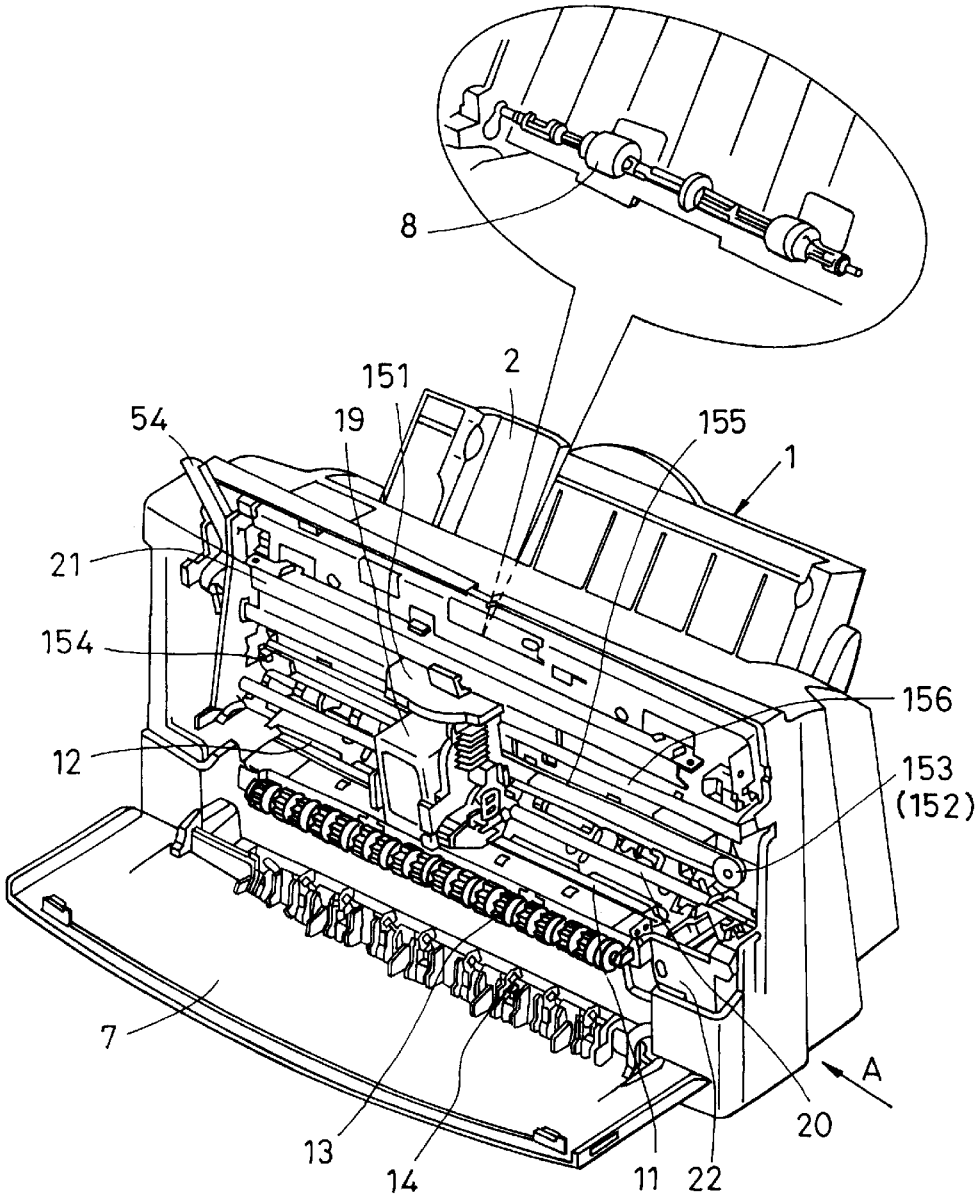
FIG. 2 is an internal perspective view of a recording apparatus of an embodiment of the invention.
Figure 3:
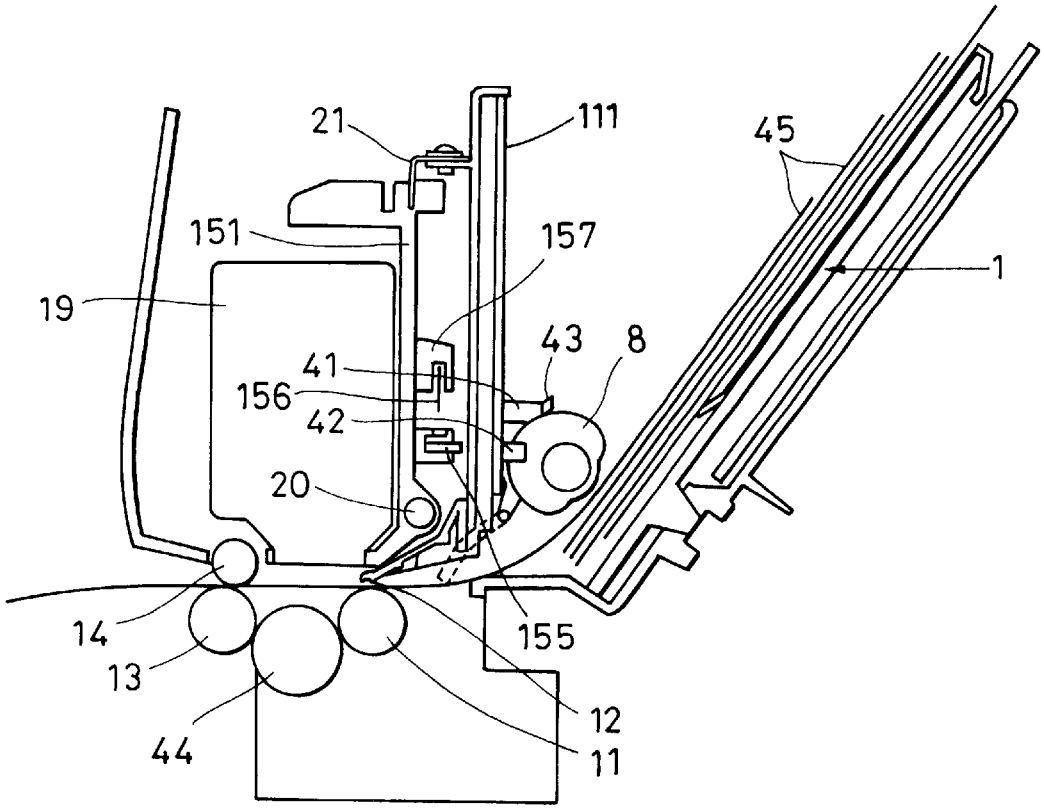
FIG. 3 is a sectional view of a recording apparatus of an embodiment of the invention.

FIGS. 1 to 3 illustrate a recording apparatus in a typical embodiment of the present invention. The apparatus mounts a plurality of recording heads for performing recording by the ink-jet method on a carriage and performs recording on a sheet of paper serving as a recording medium by serially scanning the same.

Among FIGS. 1 to 3, FIG. 1 is an exterior perspective view illustrating a whole configuration of a recording apparatus; FIG. 2 is an internal perspective view of the recording apparatus; and FIG. 3 is a sectional view of the recording apparatus.

In FIG. 1, reference numeral 1 represents an automatic paper feeder for feeding paper to a recording section; 2, a side guide, brought into abutment with the left side of a sheet of paper to ensure straight paper feed, mounted on the automatic paper feeder 1; 4, a discharge port through which a sheet after the completion of recording is discharged; 5, a discharged paper tray for holding discharged sheets; 6, an operating panel; and 7, a front cover, which is opened or closed upon replacement of the recording head or when removing sheets in a jam.

In FIG. 2, reference numeral 8 represents a paper feed roller which separates and feeds sheets mounted on the automatic paper feeder 1 one by one; 11, a transporting roller which transports sheets of paper, and is rotated by the driving force of a transporting motor not shown, which are transmitted after a reduction of speed by a slow-down gear not shown; 12, a pinch roller following the rotation of the transporting roller 11 in which a sheet of paper transported by the paper feed roller 8 to a position where the transporting roller 11 comes into contact with the pinch roller 12 is sent by the transporting force of the transporting roller 11; 13, a paper discharge roller discharging a sheet upon the completion of recording into the discharge paper tray 5; and 14, a spur pressing the sheet against the paper discharge roller 13. The spur 14 used herein means a rotary member which has a small contact area with the sheet and never disturbs an ink image even when coming into contact with the side of a sheet recording the ink image under the effect of ink discharge.

Also in FIG. 2, reference numeral 19 represents a head cartridge which is a unit provided with the recording head and an ink tank; 151, a carriage having a configuration mounting the head cartridge and which is easily detachable; 20, a guide shaft; and 21, a guide rail which guides movement of the carriage 151.

The reference numeral 152 represents a carriage motor, which is a DC motor; 155, a carriage belt stretched between a driven pulley 153 directly connected to the carriage motor 152 and an idle pulley 154. The carriage 151 is secured to the carriage belt 155 at a point.

Reference numeral 156 represents a linear encoder scale on which marks are printed at equal intervals at 360 lpi (line per inch, =25.4 mm/360=70.6 $\mu$m). It is possible to accurately determine the position of the carriage by detecting the same by an encoder sensor 157 (see FIG. 3) fixed to the carriage 151. During movement of the carriage 151, the speed of the carriage 151 can be calculated from the time interval of continuous detection of the marks on the linear encoder scale 156. In the configuration as described above, the head cartridge 19 performs a recording operation by the action of the driving force of the carriage motor 152.

Figure 6A:
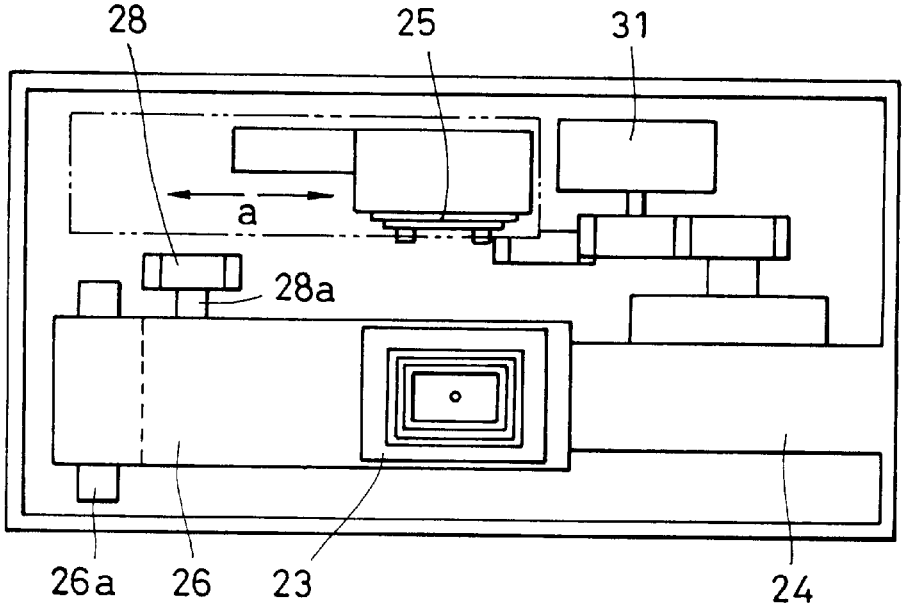
FIGS. 6A to 6B show diagrams of a recovery system of a recording apparatus of an embodiment of the invention.
Figure 6B:
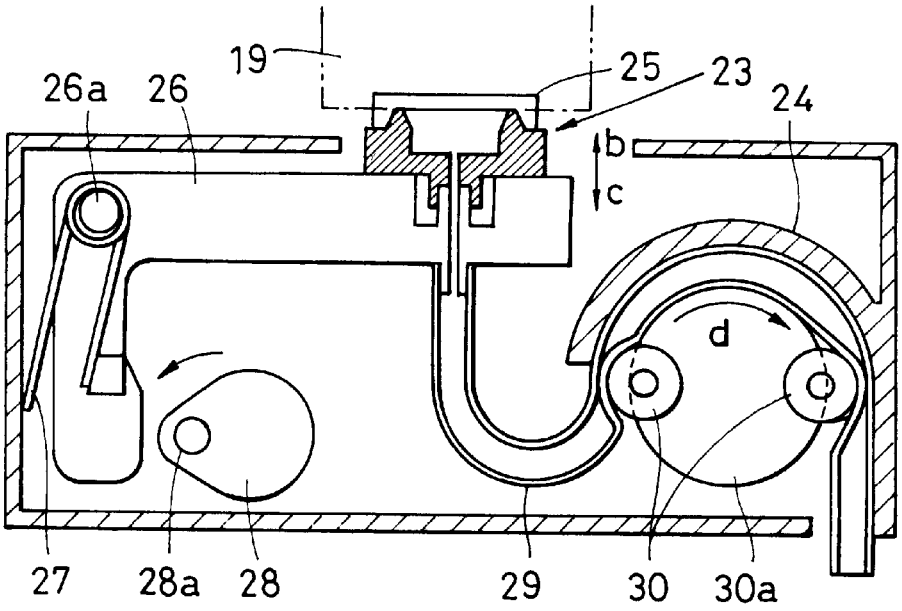

In FIG. 2, reference numeral 22 represents a recovery unit comprising a cap 23 preventing the recording head from drying during non-operation of the printer, a pump 24 giving a negative pressure to the recording head via the cap 23 and sucking the ink in the recording head, and a blade 25, which wipes the nozzle surfaces of the recording head. (Cap 23, pump 24 and block 25 are shown in FIGS. 6A and 6B.)

The operation of the recording apparatus will now be described with reference to FIG. 3. A sheet mounted on the automatic paper feeder 1 is sent to the recording section by the rotation of the paper feed roller 8. A paper feed roller flag provided on the paper feed roller 8 detects the state of the paper feed roller 8 by cutting off light to the paper feed roller sensor 42, which is a photosensor mounted on a control substrate 111. The sheet sent to the recording section is transported by the transporting roller 11 and the pinch roller 12. Reference numeral 44 represents a communicating roller which communicates the driving force of the transporting roller 11 to the paper discharge roller 13. The head cartridge 19 is arranged above the communicating roller 44, forming a recording area. The sheet onto which recording has been completed by the head cartridge 19 is discharged by the paper discharge roller 13 and the spur 14. Reference numeral 43 represents a paper end flag arranged upstream of the transporting roller 11, which cuts off light to the paper end sensor 41 mounted on the control substrate 111 when the sheet is present, and recognizes the presence of the sheet. When the trailing end of the sheet comes off the paper end flag 43, the control substrate 111 forcedly discharges the sheet in response to information from the paper end sensor 41 and executes the recording of a prescribed line from this point in time, irrespective of the presence or absence of data.

Figure 4:
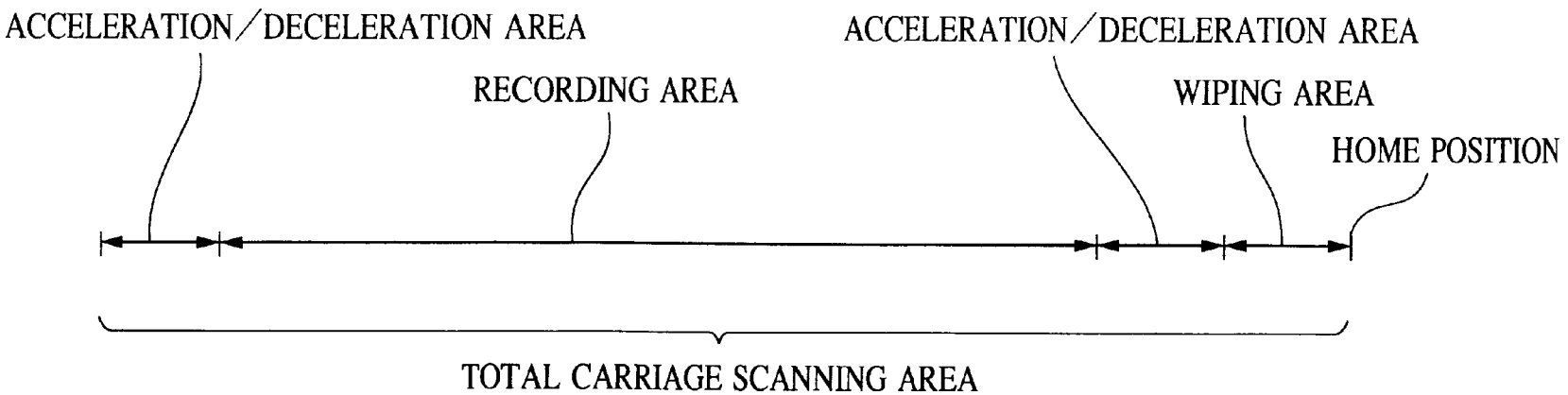
FIG. 4 illustrates a scanning range of a carriage of a recording apparatus of an embodiment of the invention.

FIG. 4 illustrates the scanning range of the carriage of the recording apparatus. The "recording area" occupies the most part of the "entire scanning range". Within this range, the carriage stably runs at a prescribed speed and performs a recording operation by discharging ink droplets from the recording head mounted on the carriage.

"Acceleration/deceleration areas" are on both sides of the "recording area". When printing over the entire width of the "recording area", acceleration is made up to a prescribed speed in the "acceleration/deceleration area" and deceleration for reversing the direction of movement is discontinued.

The "wiping area" is an area in which the blade 25 of the recovery unit and the nozzle surface of the recording head come into contact with each other to perform on operation of removing ink droplets adhering to the nozzle surface. Preliminary discharge is also conducted within this area.

The recording head is covered for protection with the cap 23 of the recovery unit. At this point, the carriage 151 is at the "home position" at the right side end in the drawing. After the ending operation when power is tuned off, the carriage 151 is at the "home position".

Figure 5A:
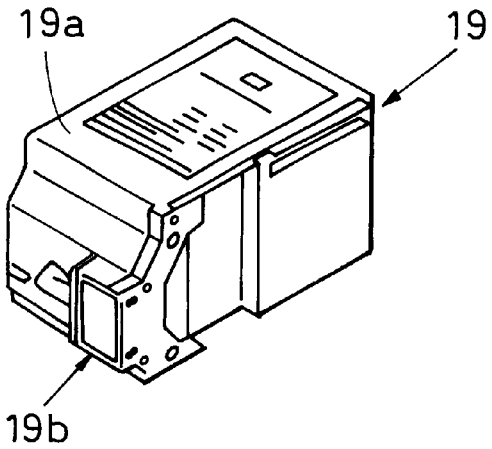
FIGS. 5A to 5C show an exterior view (FIG. 5A) and a partially enlarged view (FIG. 5B) of a head cartridge of an embodiment of the invention.
Figure 5B:
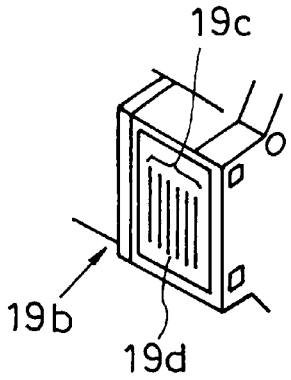
Figure 5C:
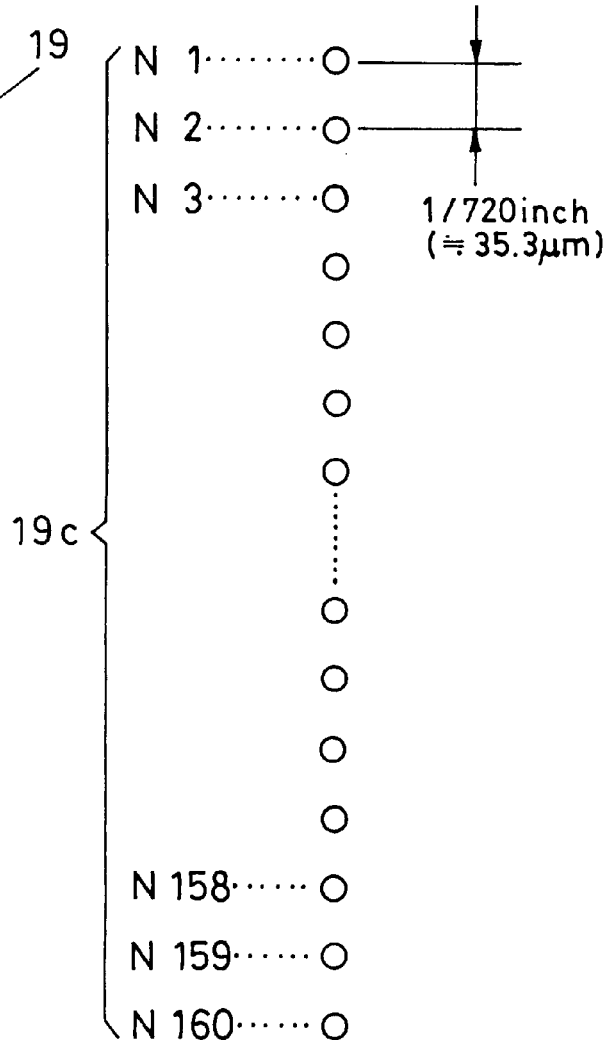

FIGS. 5A to 5C cover an exterior view and a partially enlarged view of the head cartridge 19, as well as show an enlarged one of six nozzle trains. FIG. 5A is an exterior view of the head cartridge 19, and FIG. 5B is an enlarged view of the recording head section. The head cartridge 19 comprises an ink tank section 19*a* and a recording head section 19*b*. Ink tanks and nozzle trains are provided for six colors including black, cyan, magenta, yellow, light cyan and light magenta, and permit photo color printing. Six nozzle trains 19*c* are provided in the recording head section 19*b*. Ink droplets are discharged to perform recording onto the sheet from these nozzle trains 19*c*. Reference numeral 19*d* represents head faces forming the nozzles.

FIG. 5C illustrates an enlarged one of the six nozzle trains. There are 160 nozzles in total at intervals of $1/720$ inches=about 35.3 $\mu$m. When conducting recording through a single pass using all the nozzles, placing a point on the recording speed, the amount of one line feed would be $160/720$ inches=5.644 mm. When performing recording through four passes by performing thinning out to achieve a higher recording quality, the amount of a single run of a line feed would be $40/720$ inches=1.411 mm. When a discharge state of head cartridge 19 becomes poorer, the ink is simultaneously sucked from all the nozzles by covering the above-mentioned 160×6 nozzles within a single cap 23 and producing a negative pressure in the cap 23. The head face 19*d* is substantially flat, and ink is sucked by bringing the cap 23 into pressure-contact with the face to ensure close contact to cover the nozzle trains 19*c*.

FIGS. 6A and 6B are configuration diagrams of the recovery unit 22 of the recording apparatus. FIG. 6A is a plan view of the recovery system unit 22: reference numeral 23 represents a cap; 24, a pump; 26, a cap holder supporting the cap 23; 25, a blade, and a wiping operation is performed when the carriage 151 scans over the recovery unit 22. The blade 25 is slidable in the direction shown by arrow a in FIG. 6A, and is at a shunt position when it does not perform a wiping operation. Reference numeral 31 represents a recovery system motor serving as the driving source for an up/down operation of the cap 23, a sliding operation of the blade 25 and for the pump 24.

FIG. 6B is a sectional view of the recovery unit 22. The cap 23 is in pressure-contact with a recovery head section of the head cartridge 19, and the cap holder 26 is rotatably supported around a fulcrum; 27 represents a cap spring imparting a pressure-contact force to the cap 23; 28, a cap releasing cam, which pushes down the cap 23 when the cam is turned by 180° from the position shown; 29, a tube connected to the cap 23 via a tube section provided in the cap holder 26, the tube 29 runs through a pump 24, forming a pump commonly known as a tube pump; and 30, a pump roller which, when turning in the arrow d direction in a pressure-contact state between the cap 23 and the recording head section, squeezes the tube 29 and reduces the gas pressure in the cap 23 connected thereto, thereby sucking the ink in the head cartridge 19.

Figure 7:
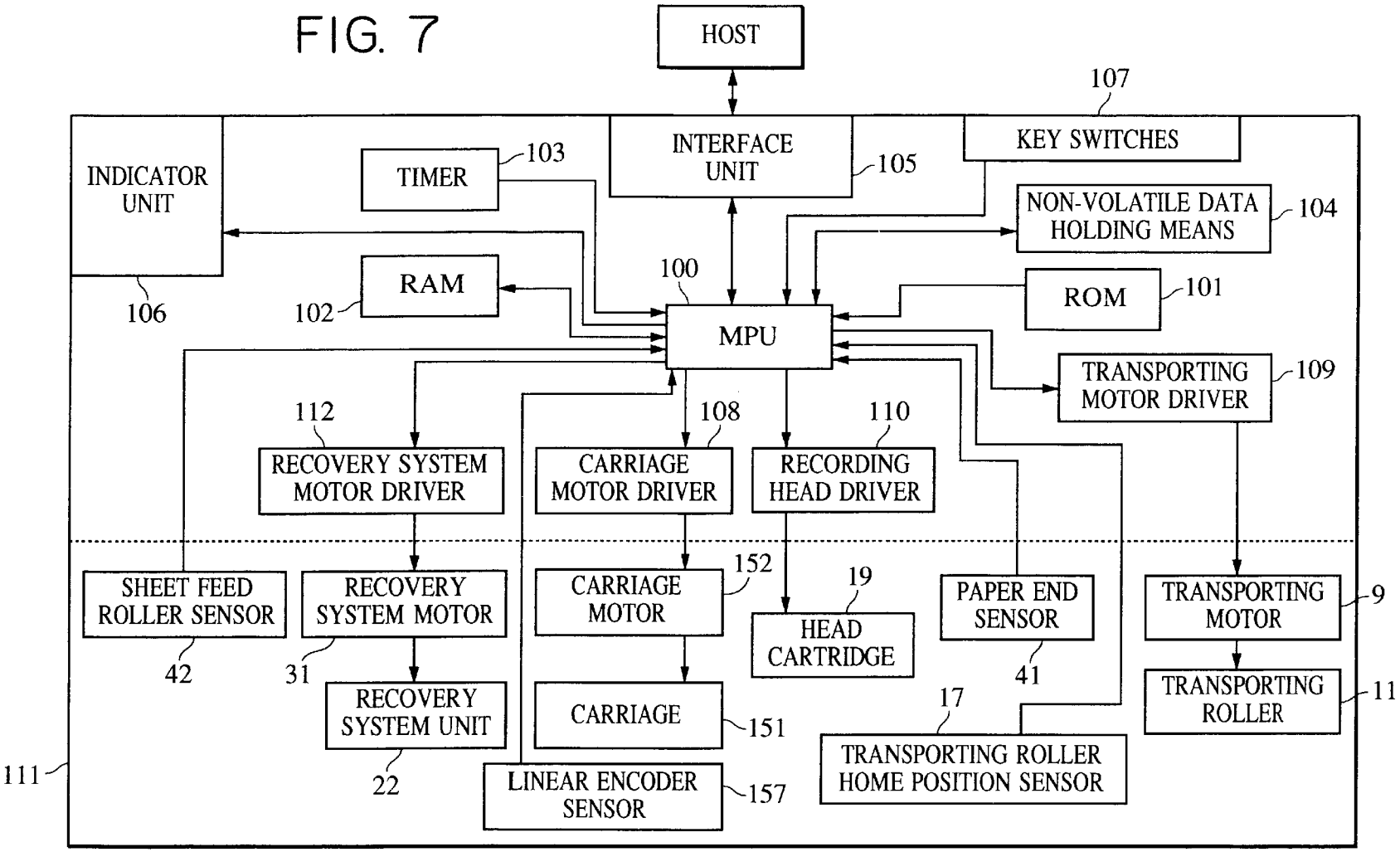
FIG. 7 is a block diagram illustrating a configuration of an electrical section of a recording apparatus of an embodiment of the invention.

FIG. 7 is a block diagram illustrating a configuration of an electrical section of the recording apparatus: reference numeral 111 represents a control substrate conducting control of various components; 100, an MPU which receives signals from the various components and issues control signals to the components, thereby controlling the entire recording apparatus; 101, an ROM storing a control procedural program; 102, an RAM used as a work area during execution of the control; 103, a timer for measuring the time; 104, non-volatile data holding means storing a corrected value of a paper feed amount, a cumulative number of records, and the amount of ink used; 105, an interface unit exchanging signals with a host such as a computer; 106, an indicator unit for notifying the user of the status of the recording apparatus; 107, key switches for the user to give instructions to the recording apparatus such as a power switch and an online switch; 108, a driver for driving the carriage motor 152 which gives a voltage of a pulse width meeting the circumstances by changing the ON/OFF duty; 109, a driver for driving the transporting motor 9; a signal being detected by the linear encoder sensor 157 being passed to the MPU 100, and converted into information of the position or the speed of the carriage 157; 110, a recording head driver for driving the recording head; and 112, a recovery system motor driver for driving the recovery motor 31.

In the present invention, the stop angle error for a turn of the transporting roller and the deviation of the transporting roller are measured with a detachable rotary encoder and a displacement sensor in a plant for assembling recording apparatuses, and the amount of transportation is corrected through calculation of a corrected pulse from the result of measurement. The transporting mechanism in the first embodiment of the invention will be described with reference to FIGS. 8 to 10.

Figure 8:
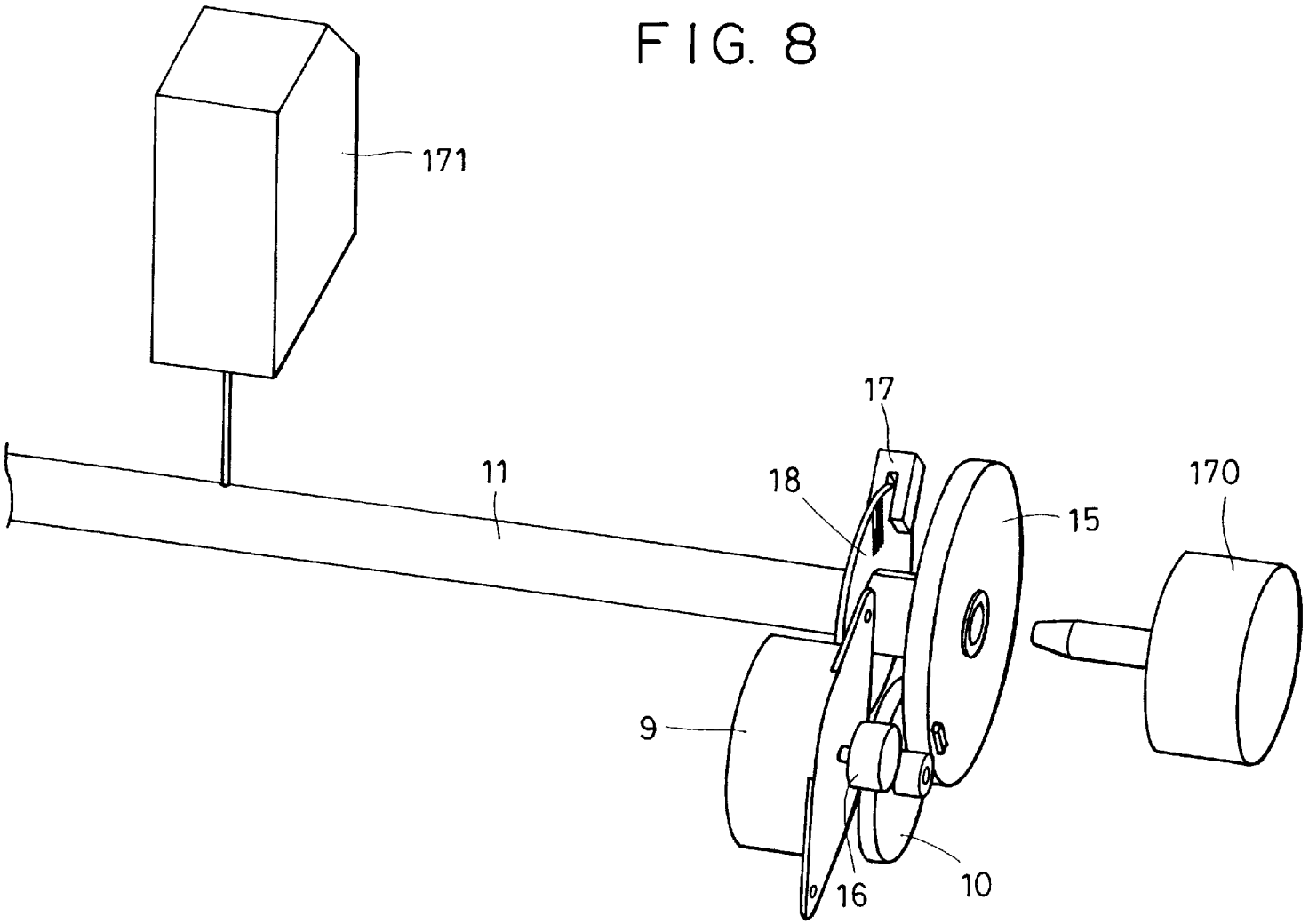
FIG. 8 is a perspective view of a transporting mechanism of a recording apparatus of an embodiment of the invention.

FIG. 8 is a perspective view of a transporting mechanism of the recording apparatus. Main components such as the transporting motor 9 are arranged at the end opposite to the recovery unit 22. The transporting roller 11 conducts transportation by holding and rotating a sheet in a pair with the pinch roller 12 as described above. A transporting roller 11, subjected to a treatment for improving the frictional coefficient of a solid or tubular metal shaft, or coated with a coating having a high frictional coefficient, or having ceramic grains deposited thereon, is suitable. The transporting motor 9, which is the driving source for the transporting roller 11, is a stepping motor of 48 steps/turn, and performs micro-step driving control which divides a step into 16; reference numeral 15 represents a transporting roller gear having a module of 0.4 and 160 teeth, and connected directly to the transporting roller 11; 10, a slow-down gear comprising a larger-diameter gear having a module of 0.6 and 60 teeth and a smaller diameter gear having a module of 0.4 and 20 teeth, and reduces the rotation of the transporting motor gear 16 having a module of 0.4 and 20 teeth in two stages of $1/3$ and $1/8$.

The reference numeral 170 represents a rotary encoder of a high resolution, and temporarily connected directly to the transporting roller 11 for measuring the stop angle error of the transporting roller 11 upon assembling in the plant. In this embodiment, it is of the laser type of 4000 pulses/turn.

Reference numeral 171 represents a high-accuracy displacement meter for measuring a change in the surface height of the transporting roller 11 during assembling at the plant, i.e., the amount of deviation. In this embodiment, it is a laser type meter having a resolution of 1 μm.

The transporting roller 11 has an attachment/detachment section for attaching and detaching the rotary encoder 170 and the displacement meter 171. After the completion of measurement, both the rotary encoder 170 and the displacement meter 171 are removed.

Reference numeral 17 represents a transporting roller home position (HP) sensor, and 18, a transporting roller HP wheel. As a result, it is possible to detect the home position of the transporting roller 11.

Figure 9:
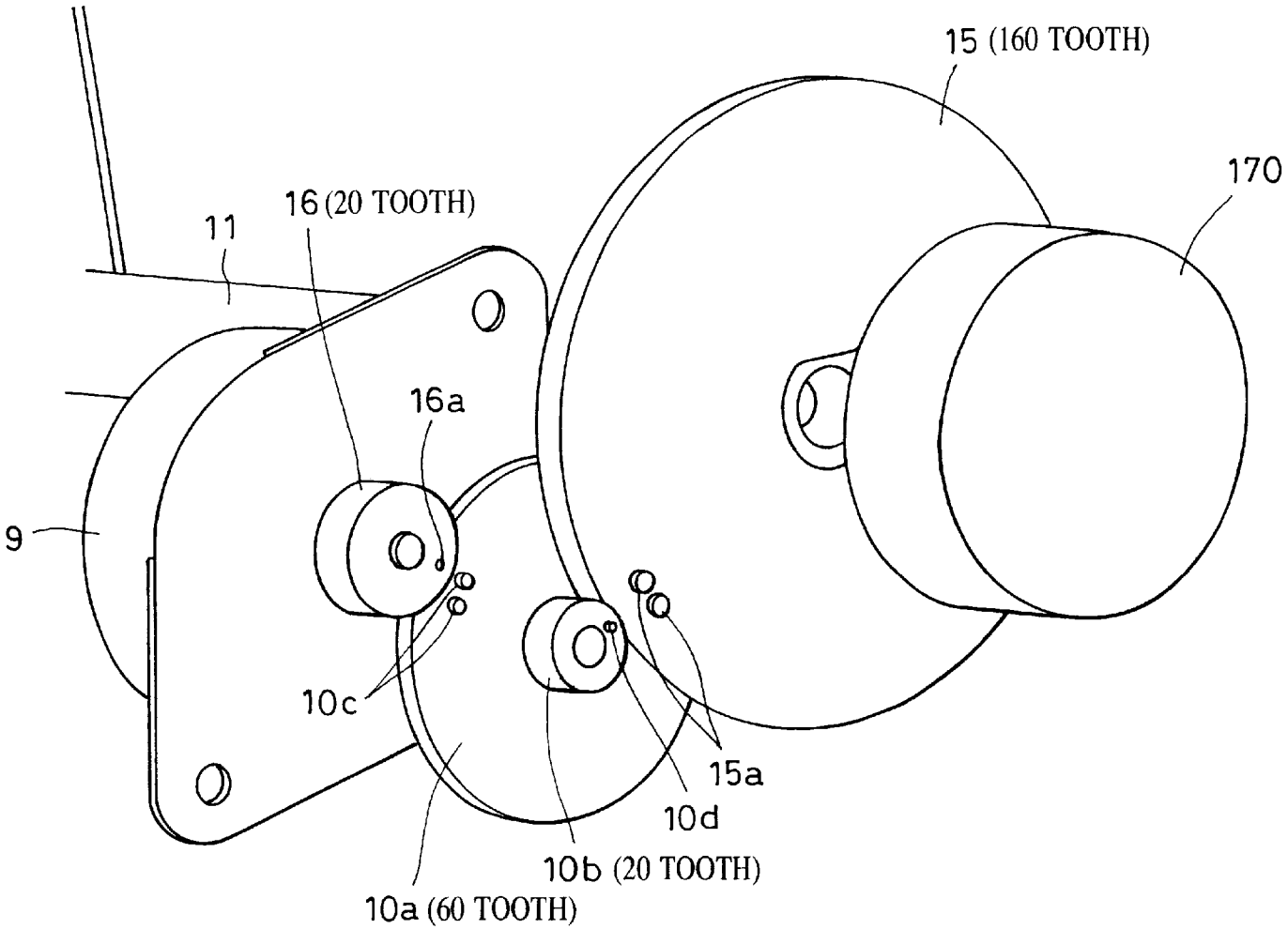
FIG. 9 illustrates a reducing gear train of a transporting mechanism of an embodiment of the invention.

FIG. 9 illustrates a reducing gear train of the transporting mechanism of the recording apparatus. Combinations of the reducing gears are set with integer ratios: when the transporting motor gear 16 turns twenty-four times, the transporting roller 11 turns once, and the transporting mechanism returns to the initial rotation positional relationship. At this point, the slow-down gear 10 turns eight times, and the transporting motor gear 16 turns once and returns to the initial state. Since the transporting motor 9 operates in 48 steps/turn as described above, it returns to the initial state after the lapse of a driving period of 48×24=1152 steps. Data of a stop angle error and an amount of deviation measured by the rotary encoder 170 and the displacement meter 171 are converted into a corrected paper feed value, which is stored in a storage area in the storage unit corresponding to the 1152 steps, i.e., in the non-volatile data holding means 104 shown in FIG. 7.

Reference numerals 16*a*, 10*c*, 10*d* and 15*a* represent marks for phase alignment of the gears. Because a corrected value of the paper feed amount becomes inappropriate if the gear engagement changes, these marks are necessary for resuming the original engagement when the gears are disassembled for maintenance or the like.

Figure 10:
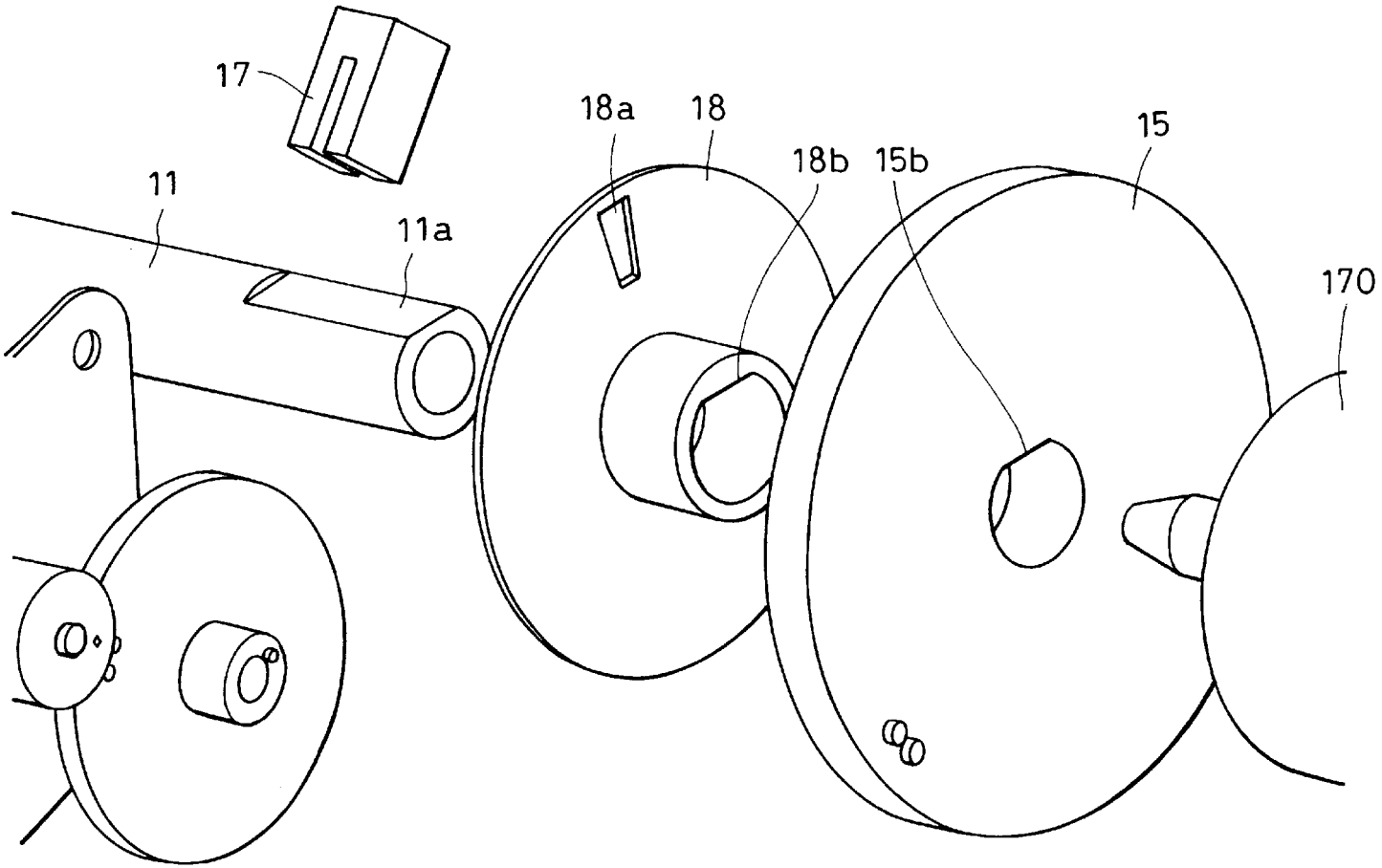
FIG. 10 illustrates a home position sensing mechanism of a transporting roller of a recording apparatus of an embodiment of the invention.

FIG. 10 illustrates the home position (HP) sensing mechanism for the transporting roller 11 of the recording apparatus. The transporting roller HP sensor 17, which is a transmissive photosensor fixed to a chassis (not shown), senses an edge of a slit 18*a* provided on the transporting roller HP wheel 18, thereby detecting the home position of the transporting roller 11. Positional shapes 11*a*, 18*b* and 15*b* are provided for the transporting roller 11, the transporting roller HP wheel 18 and the transporting gear 15, respectively, whereby the rotational position is primarily determined.

FIG. 11 is a mechanical accuracy table of the transporting mechanism of the recording apparatus. The gear class which was JGMA class 1 in the conventional art is now JGMA class 3 in this embodiment for calculation purposes. Calculation is based on the assumption of a stop angle error of the transporting motor 9 of 7.5°±5%. A deviation of the transporting roller is assumed to be 20 μm (10 μm), and a tolerance of the diameter of ±20 μm (±10 μm) is assumed for calculation. Figures in parentheses are those obtained when the paper feed accuracy was improved by increasing the part accuracy in conventional cases. Reduction of the cost of the parts is expected by reducing the accuracy of the parts.

First, the stop angle error of the transporting roller will be described.

Figure 12:
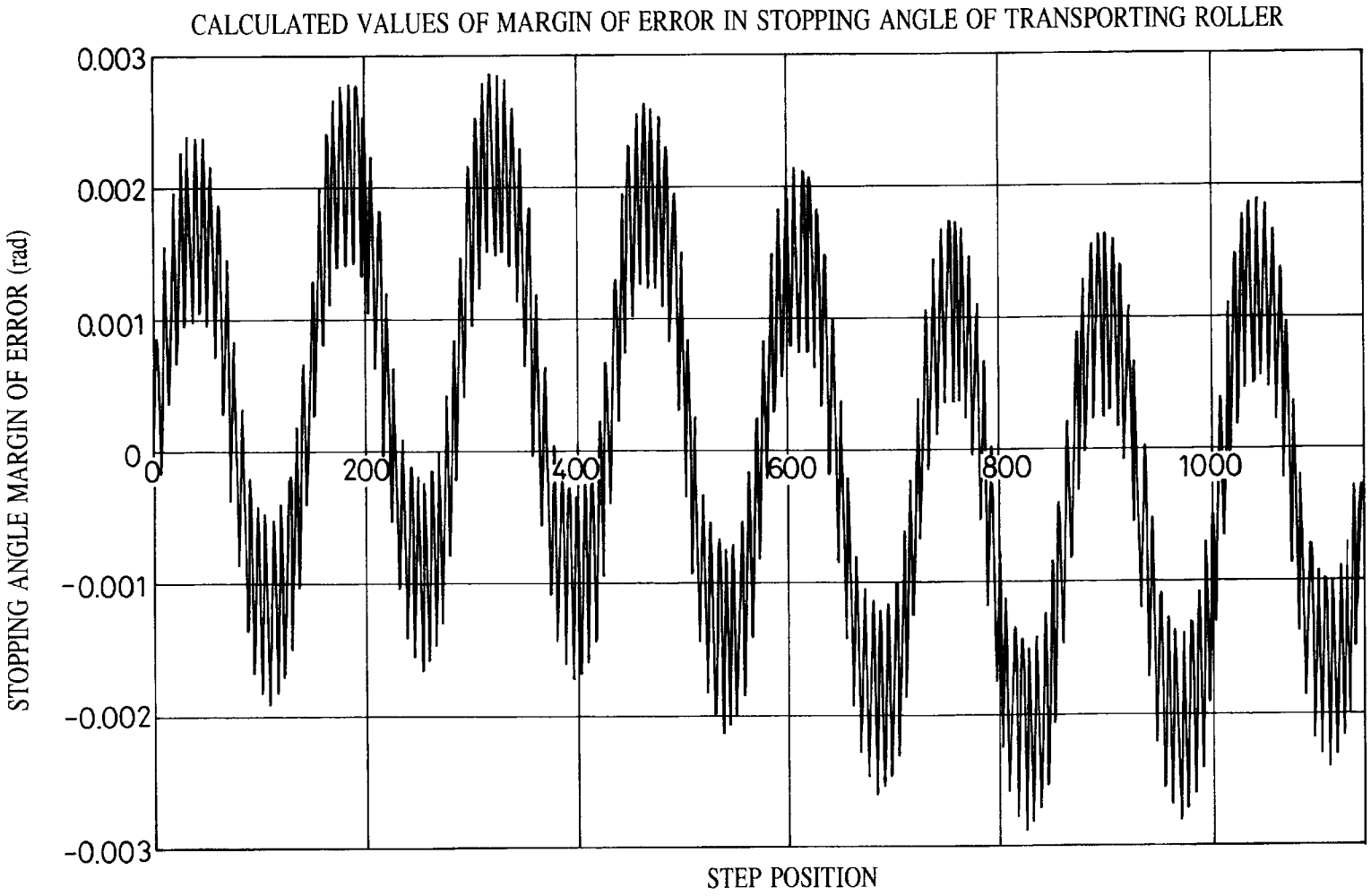
FIG. 12 is a graph showing calculated values of a stop angle error of a transporting roller of a recording apparatus of an embodiment of the invention.

FIG. 12 is a graph showing calculated values of the stop angle error of the transporting roller of the recording apparatus. Calculation is based on the worst values of the tolerable error of the parts accuracy shown in FIG. 11.

Figure 13:
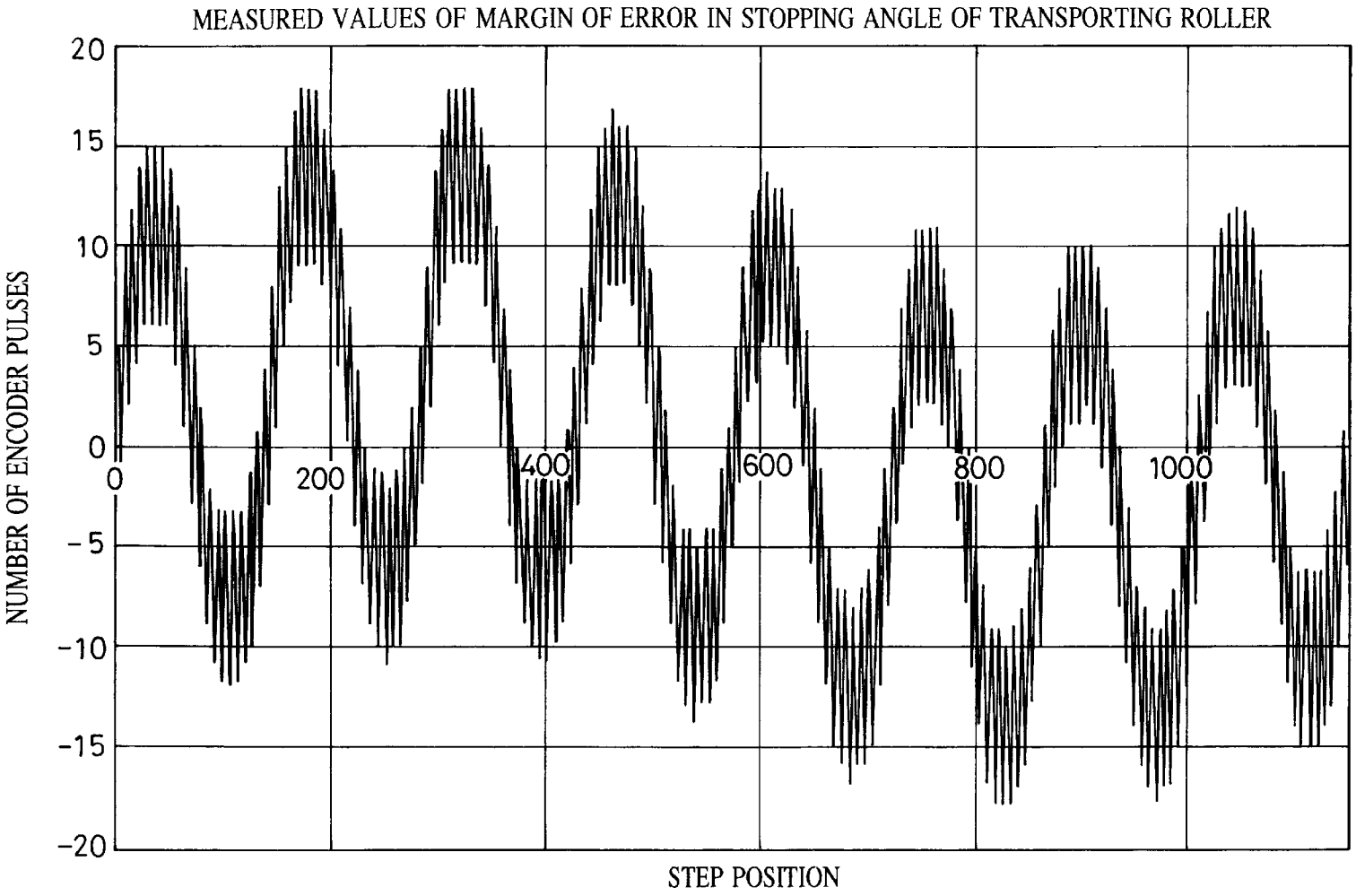
FIG. 13 is a graph showing measured values of a stop angle error of a transporting roller of a recording apparatus of an embodiment of the invention.

FIG. 13 illustrates the stop angle error of FIG. 12 as converted into a number of pulses of the rotary encoder 170. Actually, this value becomes a measured value Δθ. Since the high-resolution rotary encoder 170 has a resolution of 40,000 pulses/turn, there is obtained 2×π/40000 =0.00015708 (rad/pulse). Therefore, the maximum value of the stop angle error would be Δθ=±18 pulses.

Deviation of the transporting roller will now be described.

Figure 14:
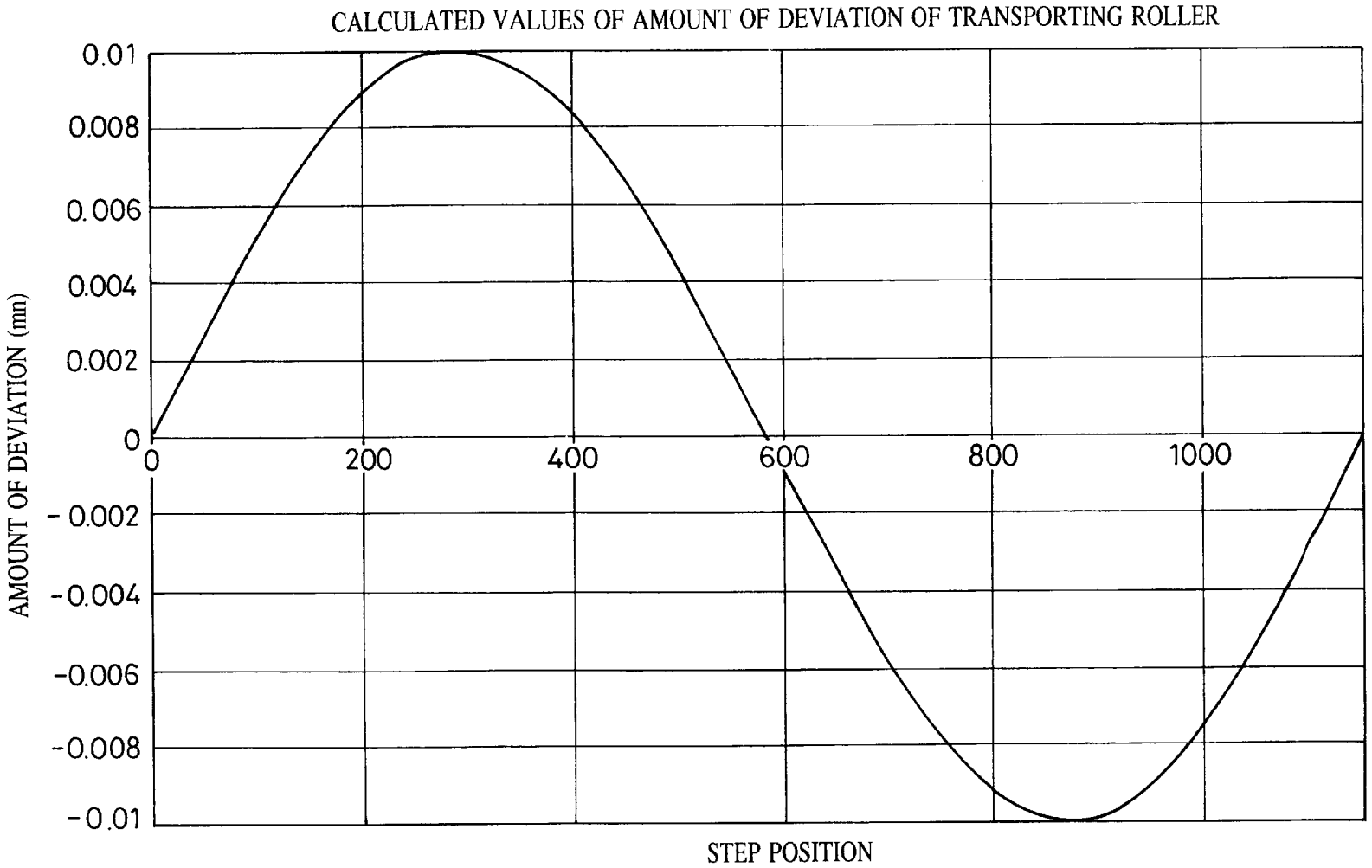
FIG. 14 is a graph showing calculated values of the amount of deviation of a transporting roller of a recording apparatus of an embodiment of the invention.

FIG. 14 is a graph showing calculated values of the amount of deviation of the transporting roller of the recording apparatus. The calculation is based on the worst deviation values shown in FIG. 11.

Figure 15:
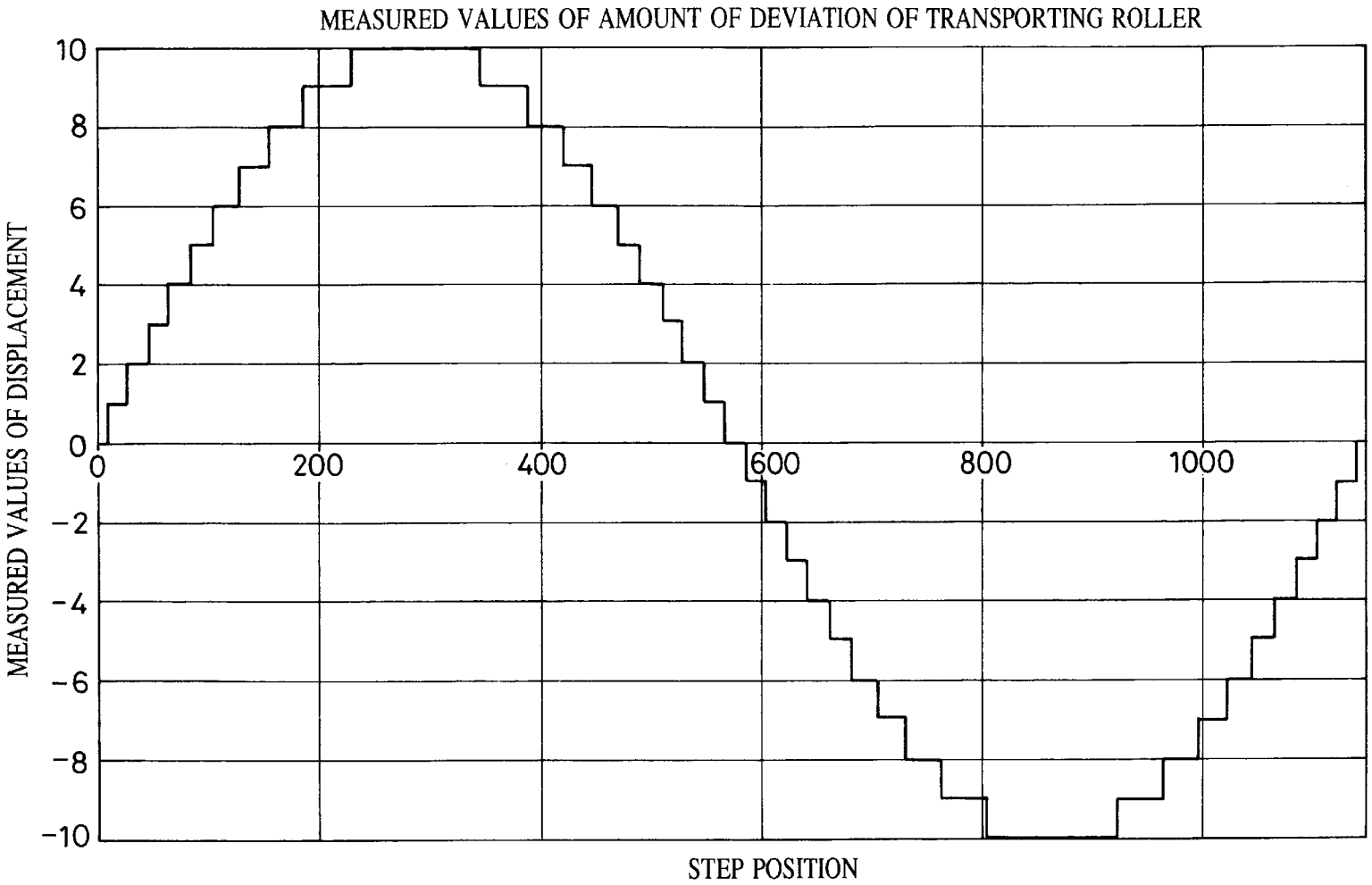
FIG. 15 is a graph showing measured values of the amount of deviation of a transporting roller of a recording apparatus of an embodiment of the invention.

FIG. 15 shows the amount of deviation shown in FIG. 14 as converted into a value of resolution of the displacement meter 171. Actually, this value becomes the measured value ΔR (μm). Because the displacement meter 171 has a resolution of 1 μm, an actual measured value is discrete.

The step of calculating a corrected pulse from the stop angle error of the transporting roller and the amount of deviation of the transporting roller will now be described.

Figure 16:
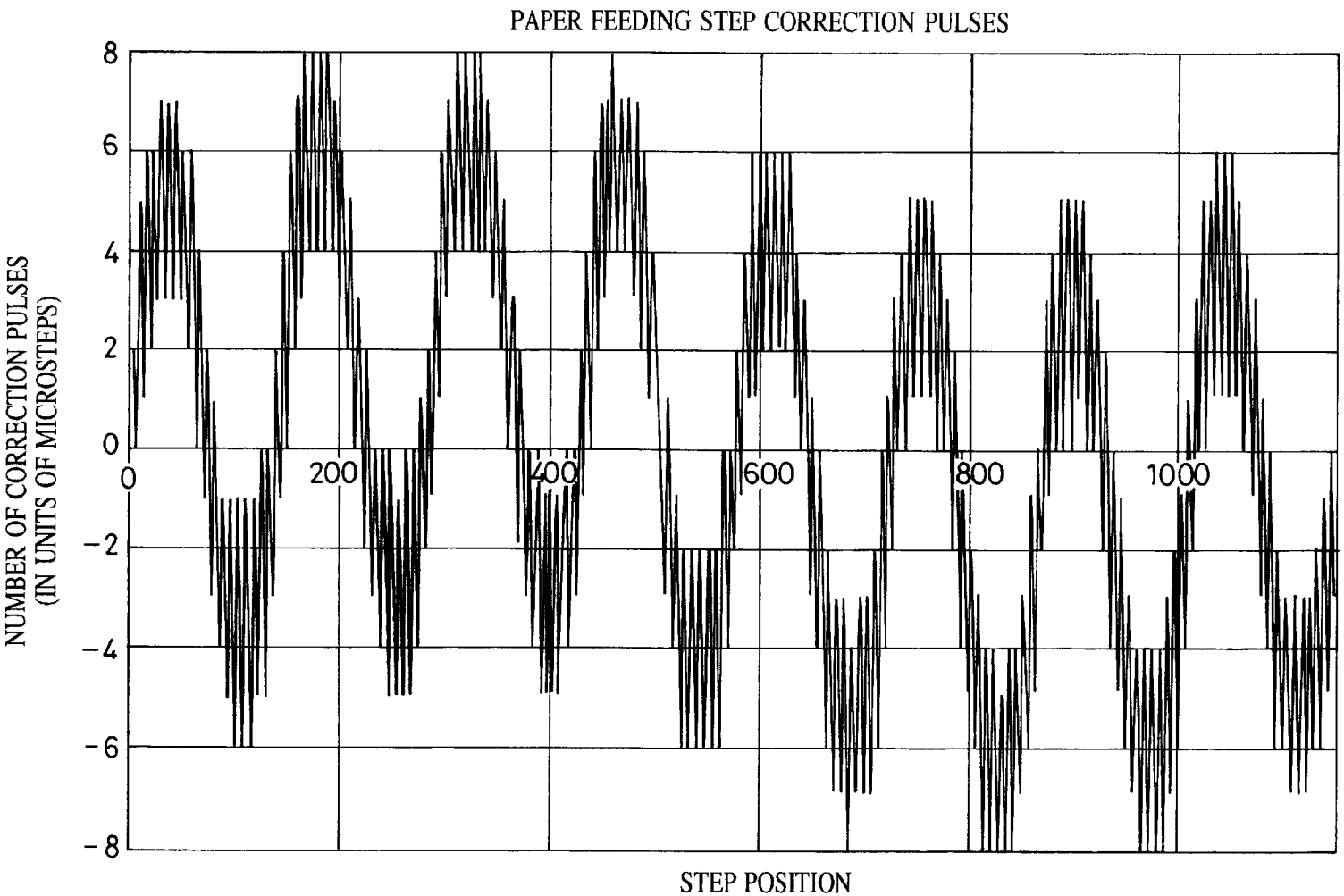
FIG. 16 is a graph showing corrected value pulses of a paper feed step of a recording apparatus of an embodiment of the invention.

FIG. 16 is a graph showing a corrected pulse of the paper feed step of the recording apparatus. This graph is calculated from measured values determined in FIGS. 13 and 15. From FIG. 11, the amount of transportation for one step of the transporting motor is 0.0353 mm. If microstep driving to divide into sixteen is applied, one step would be 0.00353 mm/16=2.205 μm. The term "the micro-step driving" means a method of driving by dividing the interval between two phases. Since the transporting roller has a radium of R (=6468 μm) from the measured value of a stop angle error of Δθ and the measured value of deviation ΔR (μm), the corrected pulse a of the micro-step dividing into sixteen is calculated as follows:

$$a=(R+\Delta R)\times\Delta\theta\times 2\times\pi/40000/2.205 \quad (1)$$

When conducting line feed control, control is performed in compliance with this corrected pulse a.

First, an error of the paper feed amount when not using the corrected pulse derived in Formula (1) as a comparative example is calculated.

Figure 17:
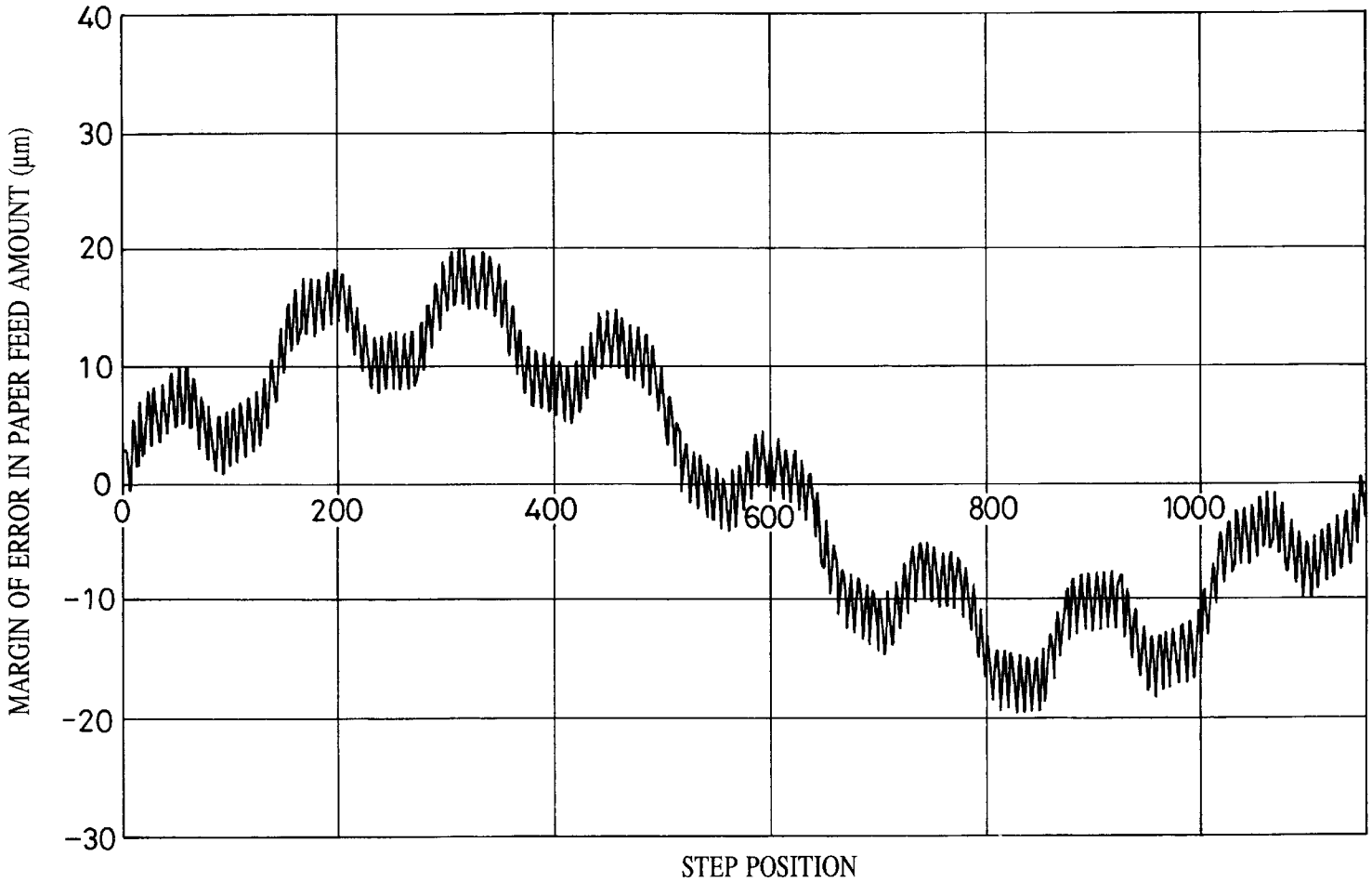
FIG. 17 is a graph showing calculated values of a paper feed amount error without a corrected pulse in an embodiment of the invention.
Figure 25:
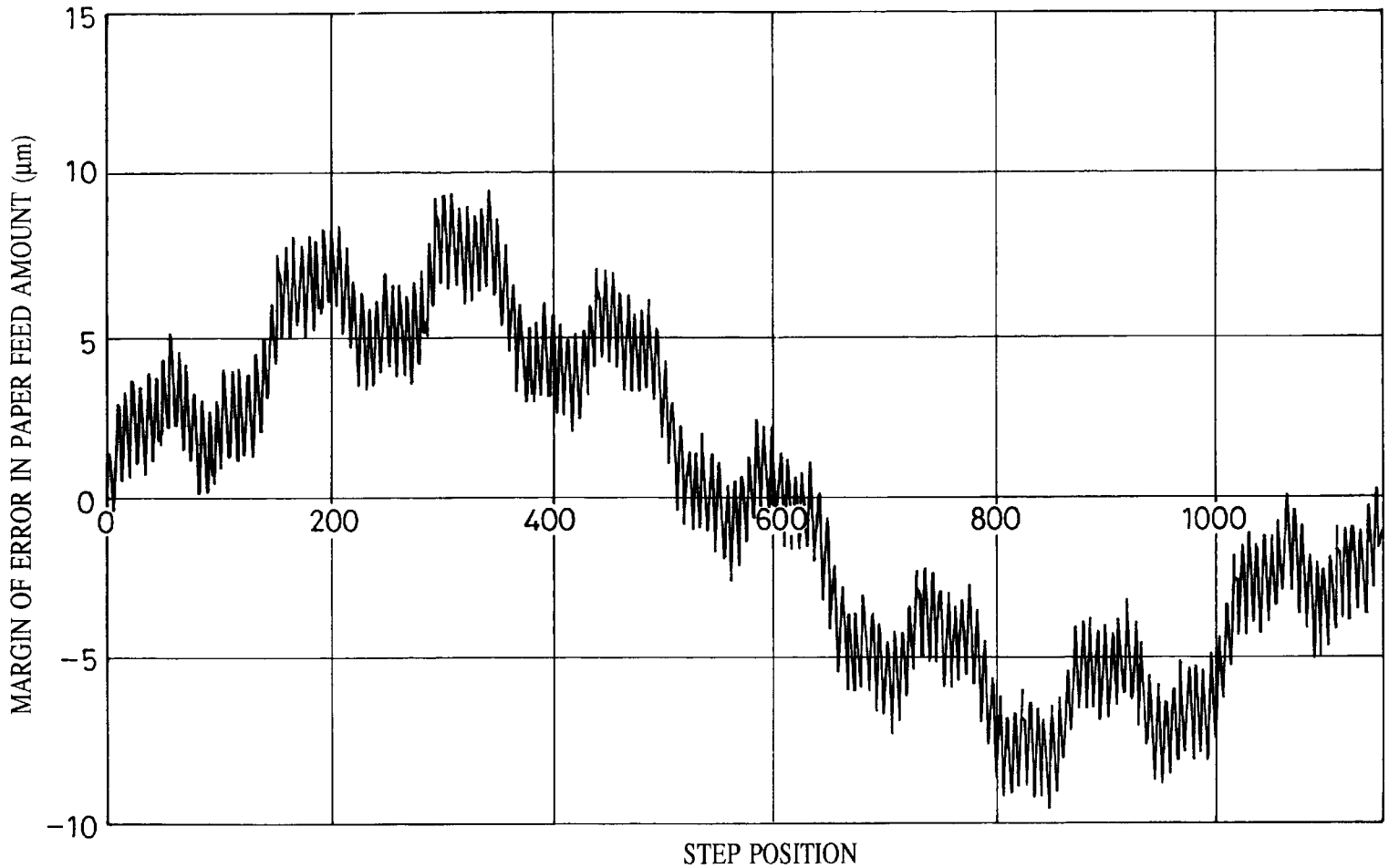
FIG. 25 is a graph showing calculated values of a paper feed amount error of a conventional recording apparatus.

FIG. 17 is a graph showing a calculated value of the paper feed amount error without a corrected pulse. This corresponds to FIG. 25 in the conventional art. Calculation is based on the worst value of the tolerable error of the parts accuracy shown in FIG. 11. An occurrence of an error of 20 μm on the maximum is expected. While an error caused by a deviation of the transporting roller 11 is contained in this graph, an increase or a decrease in the average paper feed amount caused by an error in the diameter is not contained. The average paper feed amount is considered to be ideal in this calculation.

Figure 18:
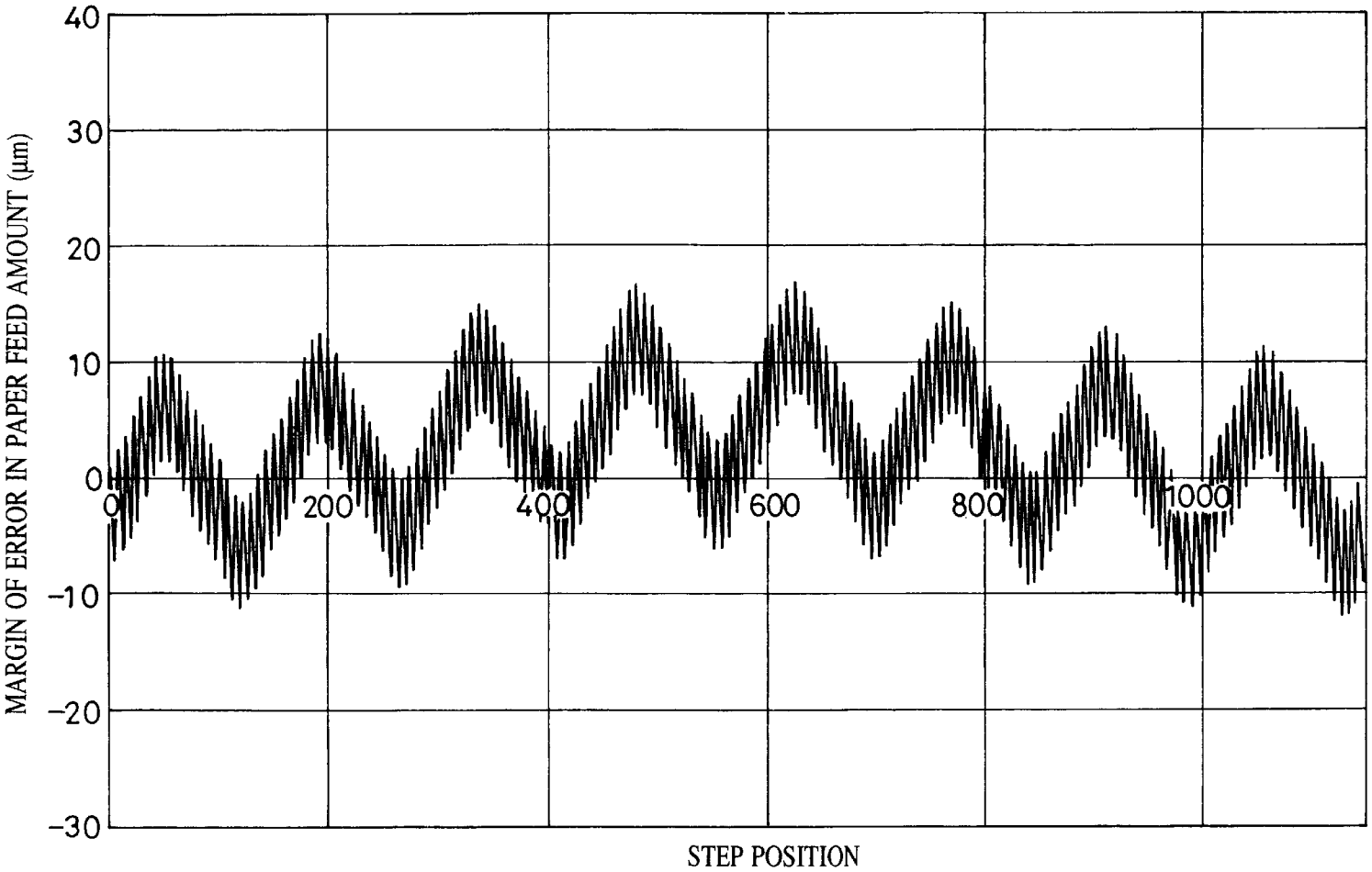
FIG. 18 is a graph showing a paper feed pitch error upon a 1/18 of an inch line feed without a corrected pulse of an embodiment of the invention.
Figure 26:
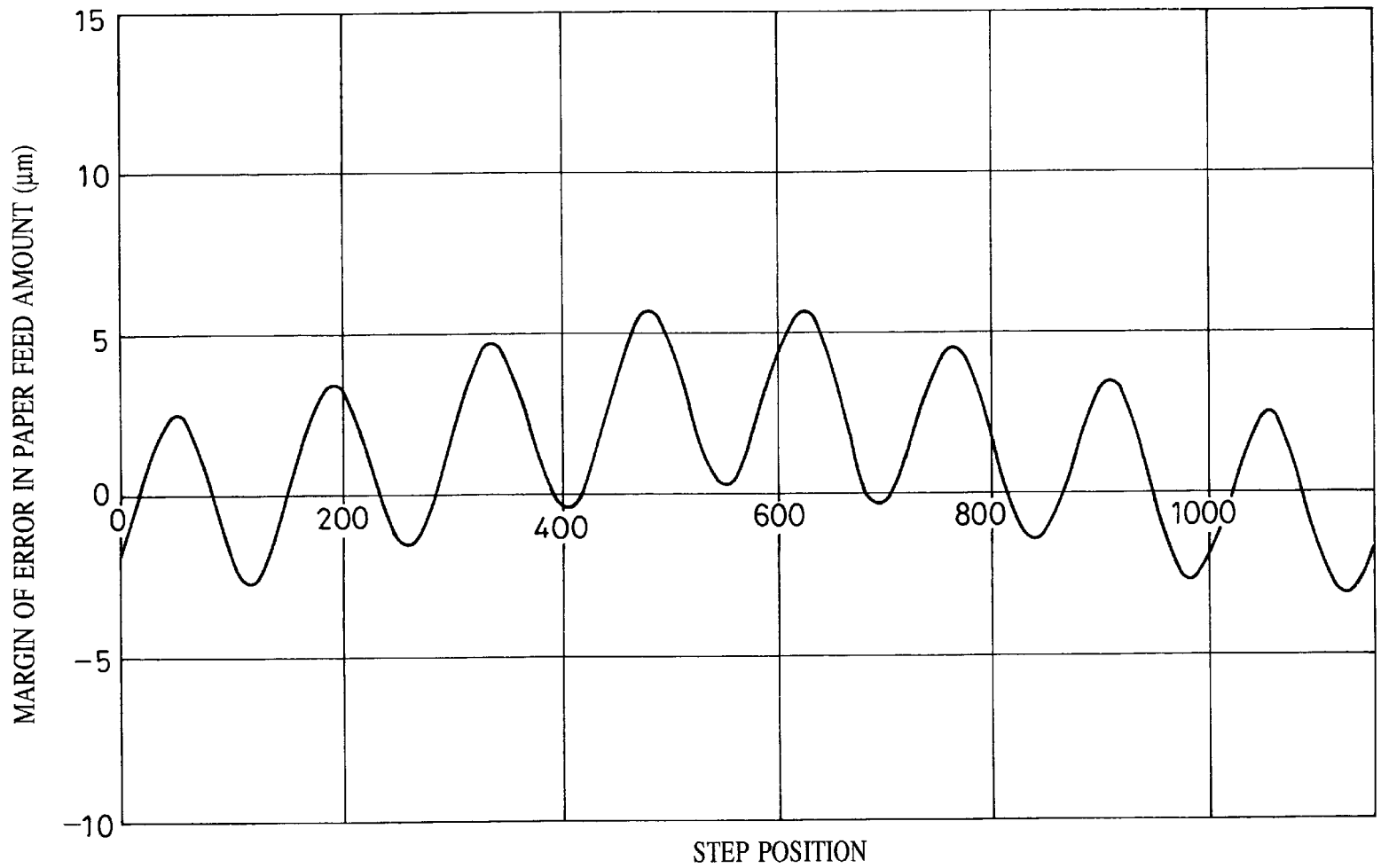
FIG. 26 is a graph showing a paper feed pitch error upon 1/18 of an inch line feed of a conventional recording apparatus.

FIG. 18 is a graph showing a paper feed pitch error upon a line feed of 1/18 of an inch without a corrected pulse, and this corresponds to FIG. 26 of the conventional art. An increase in the average paper feed amount caused by a diameter error of the transporting roller 11 is contained here. Calculation is performed with the maximum value of the tolerable error of a diameter +20 μm, and an increment of the average paper feed amount expected in 1/18 of an inch line feed +2.18 μm is added. As a result, an occurrence of a paper feed pitch error of about 16 μm is expected on the maximum upon a 1/18 of an inch line feed.

Figure 19:
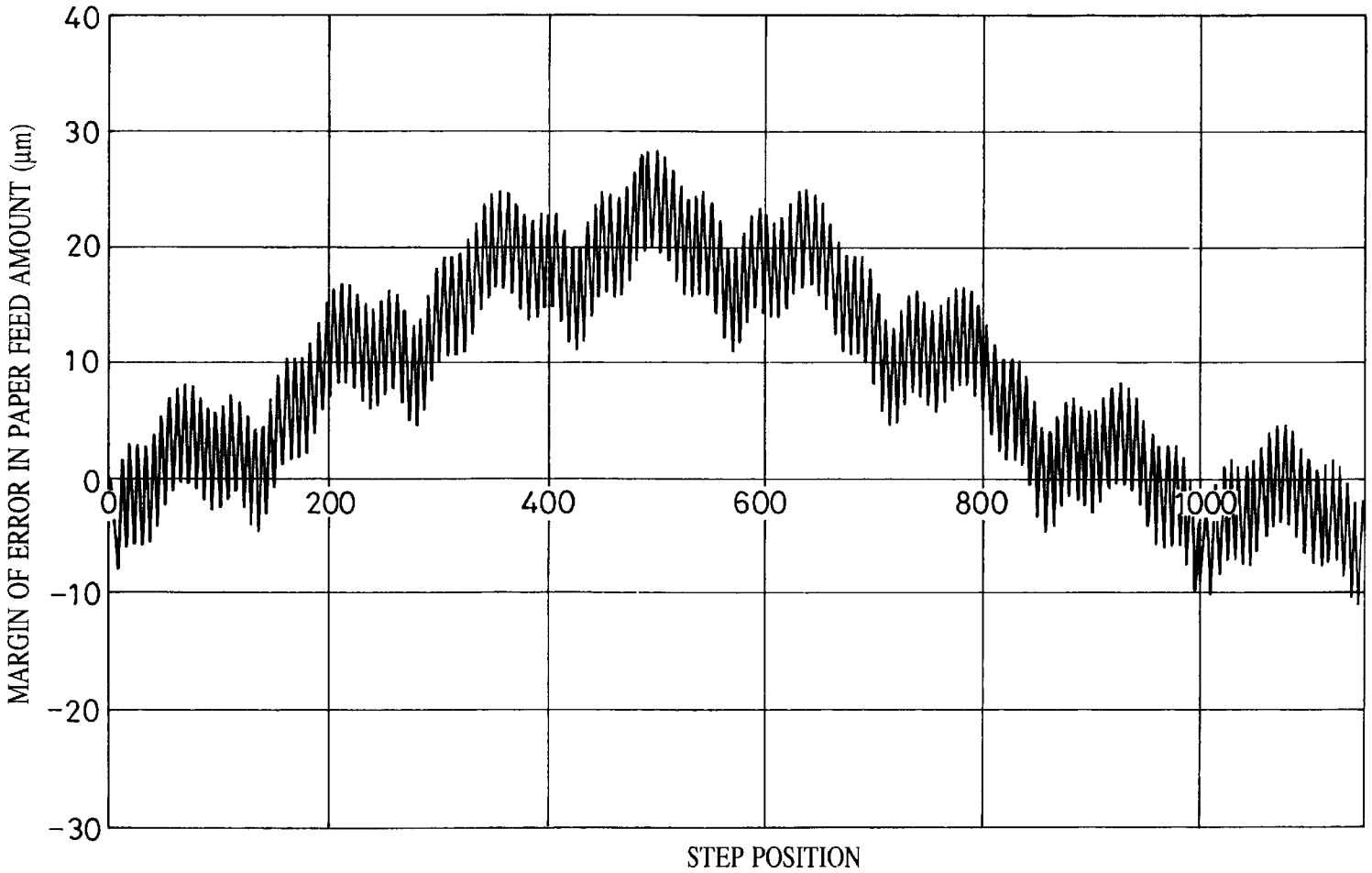
FIG. 19 is a graph showing a paper feed pitch error upon 1/18 of an inch four-line feeds without a corrected pulse of an embodiment of the invention.
Figure 27:
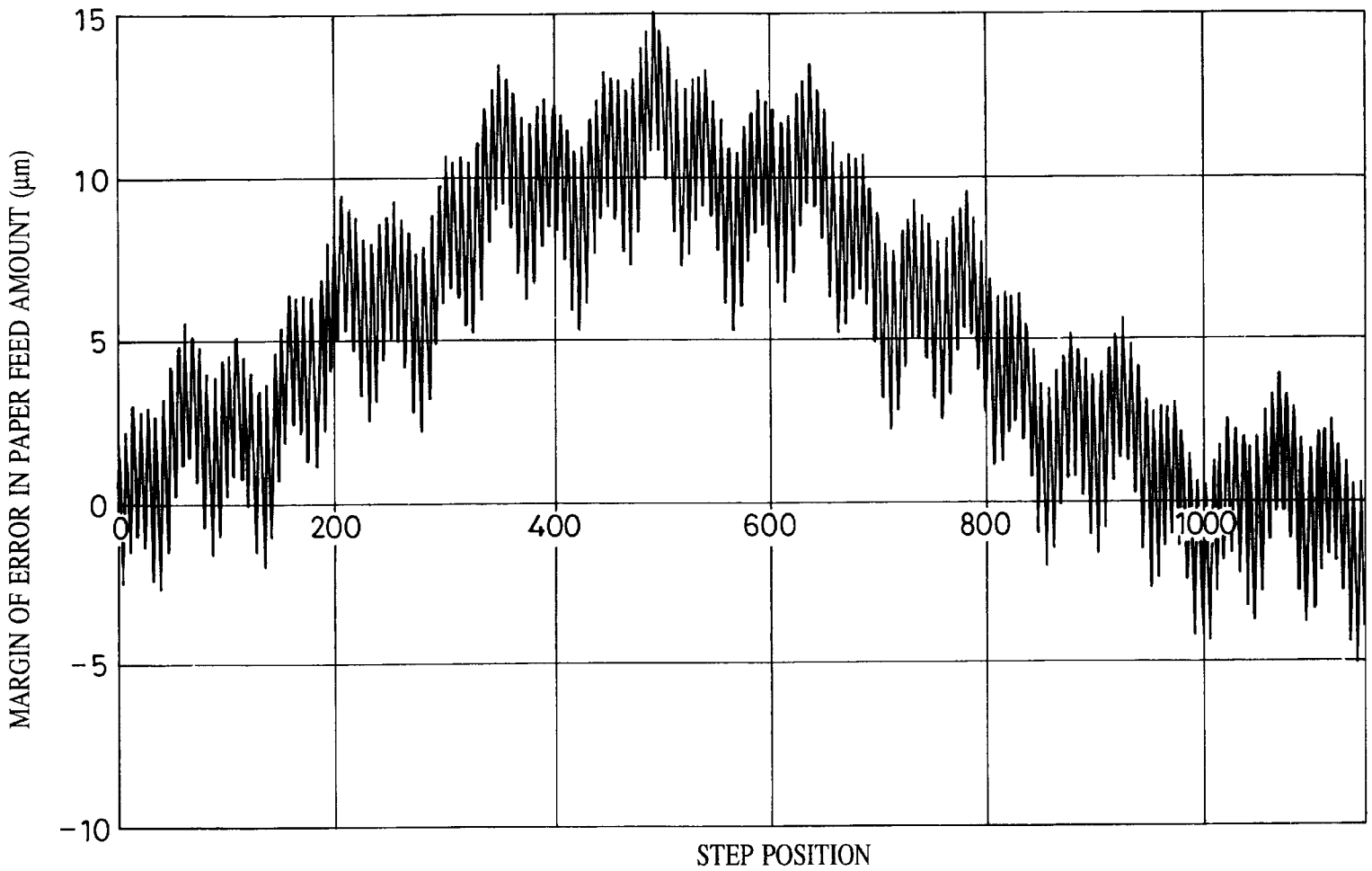
FIG. 27 is a graph showing a paper feed pitch error upon 1/18 of an inch four-line feeds of a conventional recording apparatus.

FIG. 19 is a graph showing a paper feed pitch error upon a 1/18 of an inch×4 line feed without correction. This corresponds to FIG. 27 of the conventional art. In four-pass printing, this value is important, because a positional shift from the printing after four line feeds becomes an issue. An increment in the average paper feed amount caused by a diameter error of the transporting roller 11 is contained here. Calculation is made with the maximum value of a tolerable error of a diameter +20 μm, and the increment in the average paper feed amount expected from 1/18 of an inch×4 line feeds +8.73 μm is added. As a result, a paper feed pitch error of about 28 μm is expected in the worst case upon 1/18 of an inch×4 line feeds.

An error in the paper feed amount when using a corrected pulse derived from Formula (1) will be calculated.

Figure 20:
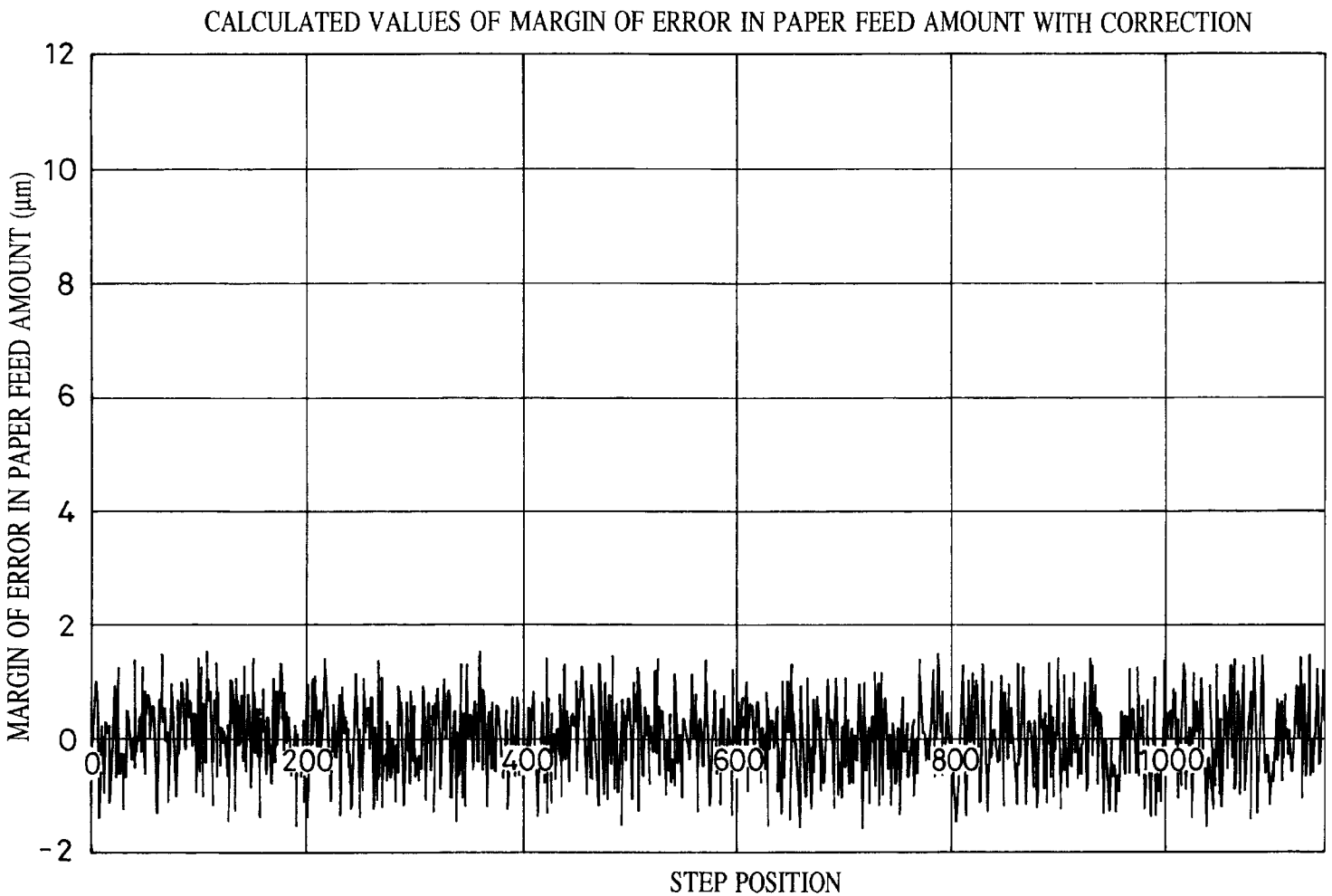
FIG. 20 is a graph showing calculated values of a paper feed amount error with a corrected pulse of an embodiment of the invention.

FIG. 20 is a graph showing an error in a paper feed amount with correction. In contrast to the value in the case without correction shown in FIG. 17, this value is corrected with the corrected pulse shown in FIG. 16. The error is inhibited to up to 2 μm on the maximum as a result of the correction. In this graph, however, while an error caused by the deviation of the transporting roller 11 is contained, an increase or a decrease in the average paper feed amount caused by a diameter error is not contained. Calculation is based on the assumption that the average paper feed amount is ideal.

Figure 21:
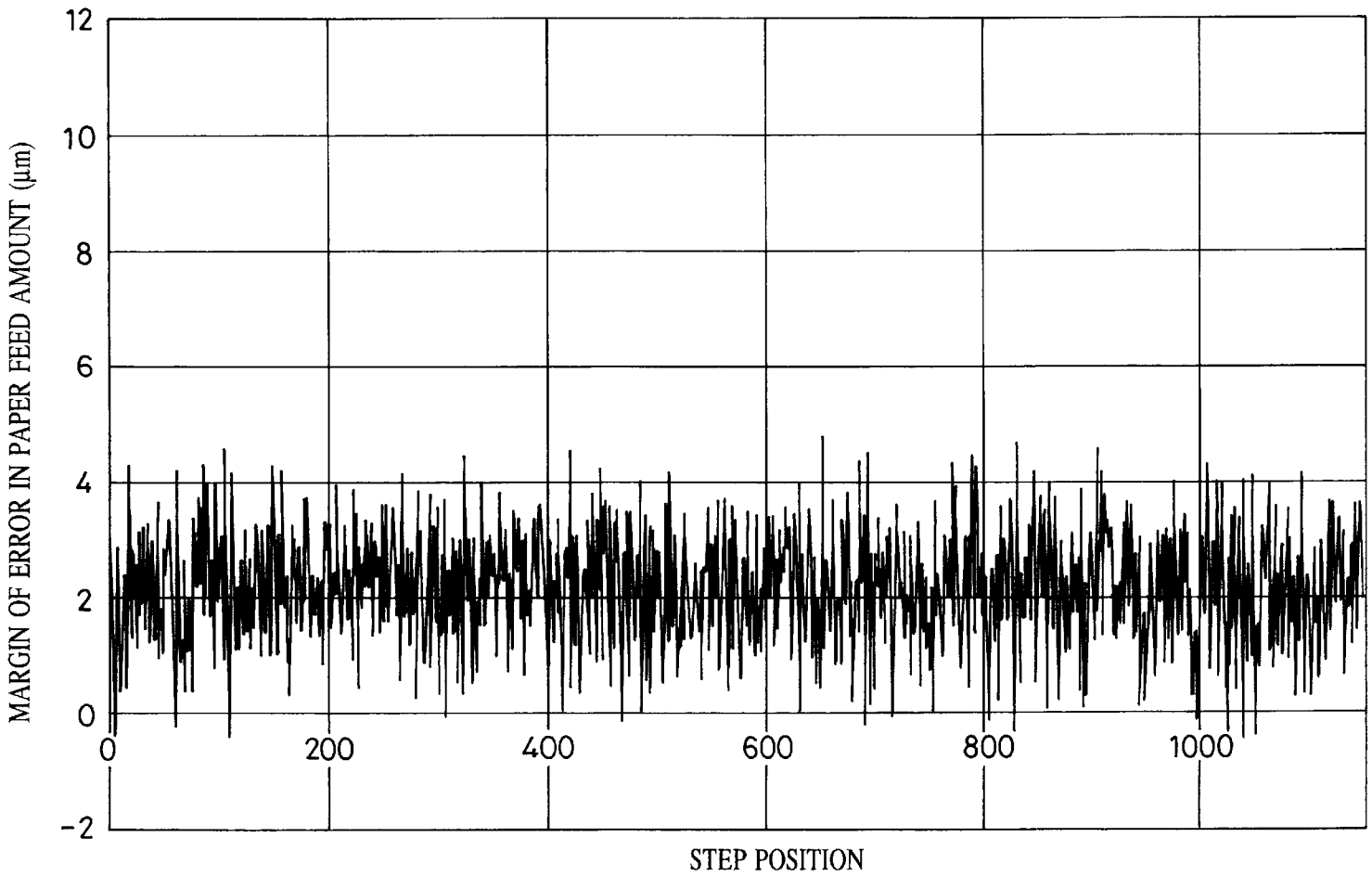
FIG. 21 is a graph showing a paper feed pitch error upon a 1/18 of an inch line feed with a corrected pulse of an embodiment of the invention.

FIG. 21 is a graph showing a paper feed pitch error upon 1/18 of an inch line feed with correction. This is the result of correction of the value without correction shown in FIG. 18 by means of the corrected pulse shown in FIG. 16. In this case also, an increment of the average paper feed amount caused by a diameter error of the transporting roller 11 is contained. Calculation is performed with the maximum value of a tolerable error of a diameter +20 μm, and an increase in the average paper feed amount expected in 1/18 of an inch line feed +2.18 μm is added. As a result, the paper feed pitch error in 1/18 of an inch line feed is limited to under 6 μm in the worst case.

Figure 22:
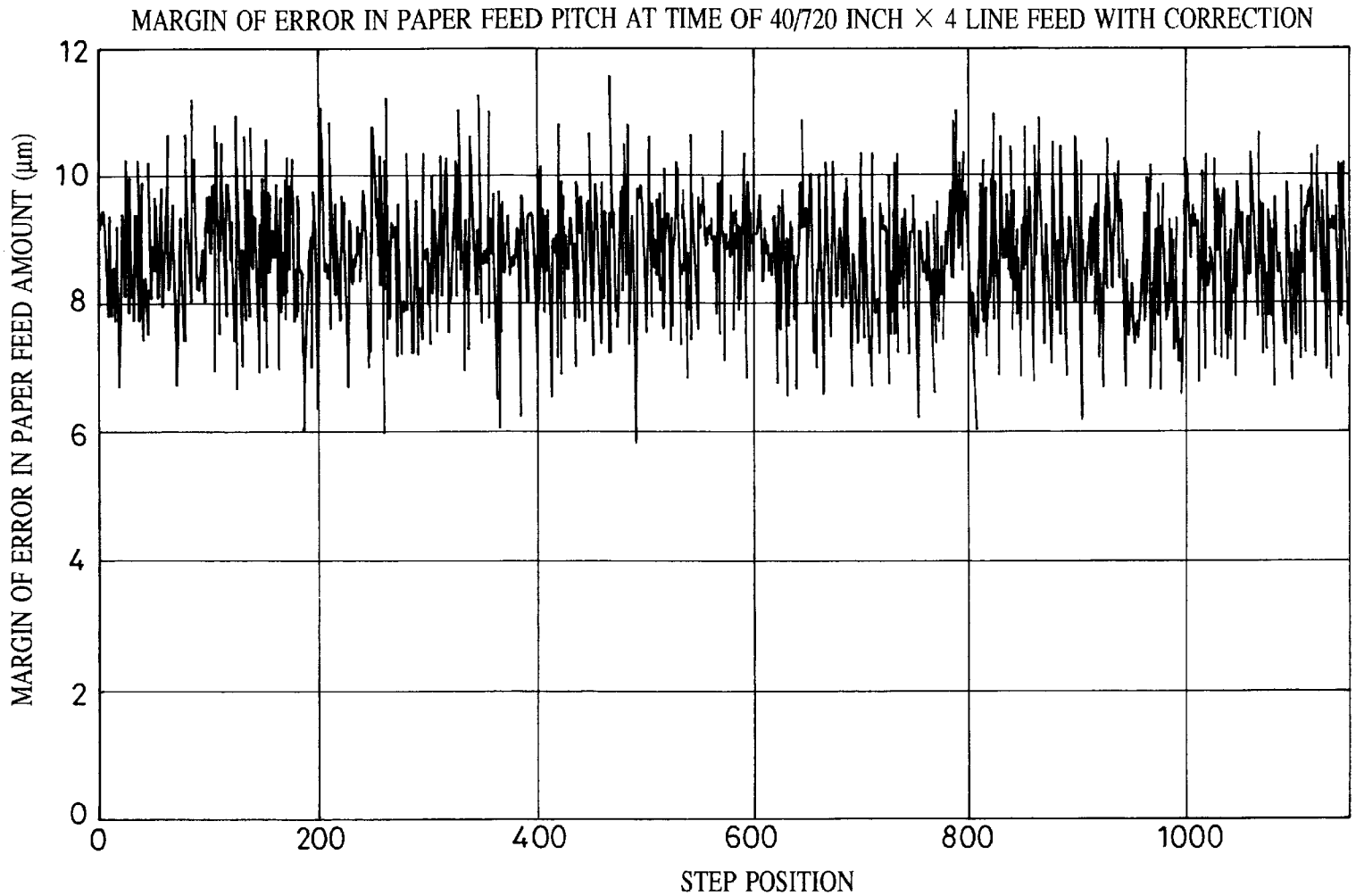
FIG. 22 is a graph showing a paper feed pitch error upon 1/18 of an inch four-line feeds with a corrected pulse of a recording apparatus of an embodiment of the invention.
Figure 23:
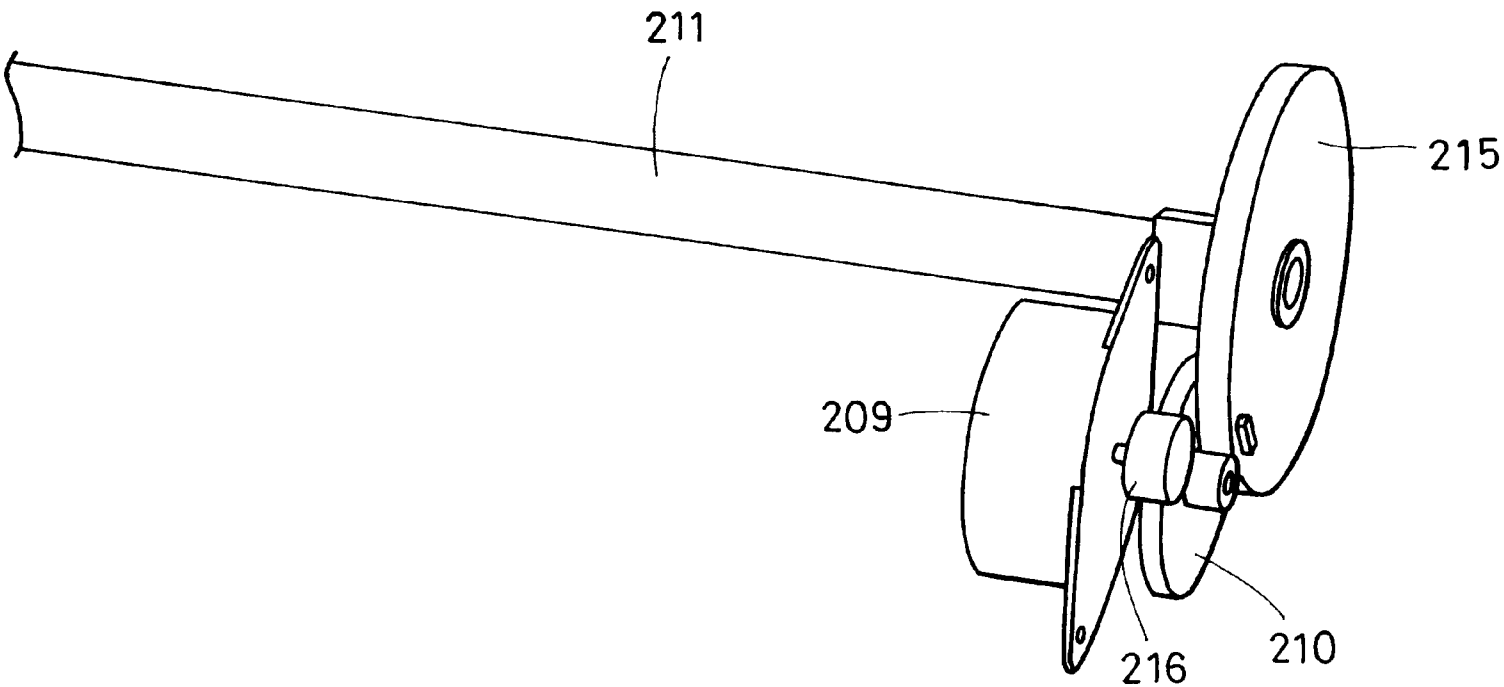
FIG. 23 is a perspective view of a transporting mechanism of a conventional recording apparatus.

FIG. 22 is a graph showing paper feed pitch error upon 1/18 of an inch×4 line feeds with correction. This is the correction of the value without correction shown in FIG. 19 by means of the corrected pulse shown in FIG. 16. In this case also, an increment of the average paper feed amount caused by a diameter error of the transporting roller 11 is contained. Calculation is performed with the maximum value of a tolerable error of a diameter +20 μm, and an increase in the average paper feed amount expected in 1/18 of an inch ×4 line feeds +8.73 μm is added. As a result, the paper feed pitch error in 1/18 of an inch×4 line feeds is limited to being under 12 μm in the worst case.

As described above, setting was made so that the other driving elements of the transporting mechanism return to an initial state upon a turn of the transporting roller, and driving is performed on the basis of a corrected pulse calculated from the stop angle error of the transporting roller and the amount of deviation of the transporting roller. In any of the 1/18 of an inch line feed and the 1/18 of an inch×4 line feeds, therefore, the paper feed pitch error can be inhibited to a low level as compared with the conventional case, in spite of the reduction of the reducing gear class.

<Second Embodiment>

In the first embodiment, the description was based on a configuration with a single slow-down gear. The present invention is not, however, limited to this, because there may be a plurality of slow-down gears or a slow-down gear may even be omitted.

<Third Embodiment>

In the first embodiment, the roller reference position detecting means detecting a rotation reference position of the transporting roller was described as being a transporting roller HP sensor, which is a transmissive photosensor, and a transporting roller HP wheel. The present invention is not, however, limited to this. For example, a reflection type photosensor or a magnetic sensor may be used.

<Fourth Embodiment>

In the first embodiment, the rotary encoder measuring the stop angle error of the transporting roller was described with reference to a laser type rotary encoder. The invention is not, however, limited to this, but any other type is applicable.

<Fifth Embodiment>

In the first embodiment, the type of the displacement meter measuring the amount of deviation of the transporting roller has been described as being a laser type one. The invention is not, however, limited to this. For example, an eddy-current type or an ultrasonic type may be adopted.

<Sixth Embodiment>

In the first embodiment, positioning means of the rotating position of the transporting roller, the transporting roller gear, and the roller reference position detecting means was described by means of marks such as projections or slits, or a D cut. The invention is not, however, limited to this, but any other type may be adopted.

<Seventh Embodiment>

In the first embodiment, the description was based on an ink-jet recording apparatus. The invention is not, however, limited to this. It may be of the heat transfer type, the thermography type, or the dot impact type.

<Others>

The present invention is provided with means for generating heat energy used for causing ink discharge (for example, a thermoelectric converter or laser beam), from among the ink-jet recording types, and brings about particularly excellent advantages in a recording head and a recording apparatus of the type that causes a change in the ink condition by such heat energy. This type permits achievement of a higher density and a higher refinement of recording.

For typical configurations and principles, the basic principles disclosed in U.S. Pat. Nos. 4,723,129, and 4,740,796 should preferably be used. This type is applicable to any of the on-demand type and the continuous type. Particularly, in the case of the on-demand type, at least a driving signal is impressed for causing a rapid temperature increase over the nuclear boiling, corresponding to recorded information, onto thermo-electric converters arranged in response to sheets or liquid paths holding a liquid (ink or treatment solution), thereby generating heat energy in the thermo-electric converters, causing membrane boiling on the heat affecting surface of the recording head, and consequently, permitting formation of bubbles in the liquid (ink or treatment solution) one-by-one corresponding to this driving signal. Thus, this arrangement provides remarkable effects. At least a droplet is formed by discharging the liquid ink (or treatment solution) via a discharging opening by growth or contraction of this bubble. If this driving signal is issued in a pulse shape, growth and contraction of the bubble are accomplished immediately and appropriately, thus making it possible to achieve a particularly excellent discharge of the liquid (ink or treatment solution), and is, therefore, preferable. The pulse-shaped driving signals disclosed in U.S. Pat. Nos. 4,463,359 and 4,345262 are suitable. More excellent recording can be effected by adopting conditions disclosed in U.S. Pat. No. 4,313,124, an invention regarding a temperature increase ratio of the above-mentioned heat affected surface.

As the configuration of the recording head, not only the configurations disclosed in the above-mentioned patent specifications comprising combinations of a discharge port, liquid paths and thermo-electric converters (linear liquid paths or orthogonal liquid paths), but also the configurations using the arrangements disclosed in U.S. Pat. Nos. 4,558,333 and 4,459,600, in which the heat affected sections are arranged at curved portions, are included in the present invention. In addition, the invention is effective also in configurations based on Japanese Patent Laid-Open No. 59-123670, which discloses a configuration in which slits common to a plurality of thermo-electric converters are used as discharge ports thereof, and Japanese Patent Laid-Open No. 59-138461, which discloses a configuration in which pores absorbing pressure liquid of heat energy are arranged to face corresponding discharge ports. In other words, according to the present invention, recording can be certainly and efficiently accomplished, irrespective of the form of the recording head.

Furthermore, the invention is valid, in addition to the serial type mentioned above, for a recording head fixed to the apparatus body, a replaceable chip type recording head to which a supply of ink is permitted through a connection with the apparatus body or from the apparatus body, or a cartridge type recording head in which an ink tank is provided integrally with the recording heat itself.

Moreover, the present invention is effectively applicable also to a full-line type recording head having a length corresponding to the maximum width of the recording medium on which the recording apparatus can record. The recording head of this type may have a configuration in which the length is filled by the combination of a plurality of recording heads, or a configuration in which the recording head is integrally formed.

It is desirable to add discharge recovery means of the recording head, or a preliminary auxiliary means as components of the recording apparatus of the invention, because such an addition further stabilizes the advantages of the present invention. More specifically, capping means, cleaning means, pressurizing or sucking means, preliminary heating means by use of thermo-electric converters or separate heating elements or combinations thereof, and preliminary discharge means performing discharge separately from recording can be utilized.

As to the kind and number of the mounted recording head, for example, a single head corresponding to monochromatic ink, or a plurality of heads corresponding to a plurality of kinds of ink different in recorded color or density may be used. More specifically, the recording mode is not limited to a main color such as black, but the invention is very effective for a multi-color apparatus or a full-color recording mode apparatus, or an apparatus having at least one of various recording modes, and the recording heads may be integrally formed or a plurality of different heads may be combined.

In the embodiments of the invention described above, the description has been based on liquid ink. However, it is also possible to adopt ink which solidifies at room temperature or a lower temperature and softens or liquefies at room temperature, or in the area of the ink-jet method, ink which is liquefied upon imparting a recording signal, because it is the usual practice to apply temperature control so as to bring the ink viscosity within a stable discharge range through temperature adjustment within a range of from 30° C. to 70° C. With a view to positively utilize the temperature increase brought by heat energy for a change in phase from solid to liquid, or preventing evaporation of ink, ink solidifying in storage and which is liquefied by heating may be used. In any event, the present invention is applicable when using ink liquefied only upon imparting of heat energy such as ink which is liquefied by imparting heat energy in response to a recording signal, and is discharged as a liquid ink, or ink which begins solidifying at a point of reaching the recording medium. In such a case, the ink may take a form placed opposite to the thermo-electric converters in a state held in cavities on a porous sheet or in throughholes as a liquid or solid, as disclosed in Japanese Patent Laid-Open Nos. 54-56847 and 60-71260. In the present invention, the most effective practice for all the kinds of ink described above is to execute the above-mentioned membrane boiling method.

The form of the ink-jet recording apparatus of the invention may be an image output terminal of an information processing device such as a computer, a copying machine in combination with a reader or the like, or a facsimile machine having transmission/receiving functions.

According to the present invention, as described above, there is provided a recording apparatus performing recording onto a recording medium by recording means, comprising transporting means for transporting the recording medium, the transporting means comprising a combination of driving elements including a transporting motor and a transporting roller and set so that, upon completion of a turn of the transporting roller, the other driving elements are reset to an initial state; a detecting section showing a reference position of the transporting roller on the transporting roller; a reference position detector detecting the detecting section and outputting a detection signal; a rotation angle measuring device measuring the rotation angle of the transporting roller, detachably attached so the transporting roller; a storage unit for previously storing a number of driving pulses corrected so that the quantity of transportation of the transporting roller is kept constant on the basis of information from the rotation angle measuring device for a turn of the transporting roller; and a controller driving-controlling the transporting motor on the basis of the corrected number of driving pulses stored in the storage unit, thus improving the line feed pitch accuracy of the recording paper without an increase in cost.

Except as otherwise disclosed herein, the various components shown in outline or in block form in the Figures are individually well known and their internal construction and operation are not critical either to the making or using of this invention or to a description of the best mode of the invention.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A recording apparatus for performing recording onto a recording medium by recording means, said apparatus comprising:

transporting means for transporting the recording medium, said transporting means comprising a combination of driving elements including a transporting motor and a transporting roller and set so that, upon completion of a turn of said transporting roller, the other driving elements are reset to an initial state;

a detecting section, arranged on said transporting roller, showing a reference position of said transporting roller;

a reference position detector detecting said detecting section and outputting a detection signal;

a rotation angle measuring device, being detachably attached to said transporting roller, for measuring a rotation angle of said transporting roller;

a storage unit for previously storing a number of driving pulses corrected so that the amount of transportation generated by said transporting roller is kept constant, on the basis of information from said rotation angle measuring device for a turn of said transporting roller; and a controller driving-controlling said transporting motor on the basis of the corrected number of driving pulses stored in said storage unit.

2. A recording apparatus according to claim 1, wherein said transporting motor is a stepping motor.

3. A recording apparatus according to claim 1, wherein said transporting motor and said driving elements, including said transporting motor, includes a positioning device primarily determining a rotation position of said reference position detector of said transporting roller.

4. A recording apparatus according to claim 1, further comprising has an adjusting system which automatically performs a step of storing the number of driving pulses for a turn of said transporting roller, corrected so as to provide a constant quantity of transportation of said transporting roller on the basis of the information from said rotation angle measuring device.

5. A recording apparatus according to claim 1, wherein said recording means comprises an ink-jet recording head for forming an image by discharging ink.

6. A recording apparatus according to claim 5, wherein said ink-jet recording head records an image by means of ink liquid droplets formed by heat energy.

7. A recording apparatus for performing recording onto a recording medium by recording means, said apparatus comprising:

transporting means for transporting the recording medium, said transporting means comprising a combination of driving elements including a transporting motor and a transporting roller, and set so that, upon completion of a turn of said transporting roller, the other driving elements are reset to an initial state;

a detecting section, arranged on said transporting roller, showing a reference position of said transporting roller;

a reference position detector detecting said detecting section and outputting a detection signal;

a rotation angle measuring device, being detachably attached to said transporting roller, for measuring a rotation angle of said transporting roller;

a surface height measuring device, being detachably attached to said transporting roller, for measuring a surface height of said transporting roller;

a storage unit for previously storing a number of driving pulses for a turn of the transporting roller corrected so as to give a constant amount of transportation of said transporting roller, on the basis of information from said rotation angle measuring device and said surface height measuring device; and a controller driving-controlling said transporting motor on the basis of the corrected number of pulses stored in said storage unit.

8. A recording apparatus according to claim 7, wherein said transporting motor is a stepping motor.

9. A recording apparatus according to claim 7, wherein said driving elements, including said transporting motor and said transporting roller, include a positioning device primarily determining a rotating position of reference position detecting means of said transporting roller.

10. A recording apparatus according to claim 7, further comprising an adjusting system automatically performing a step of primarily storing in said storage unit the number of driving pulses for a turn of the transporting roller, corrected so as to provide a constant amount of transportation of said transporting roller, on the basis of the information from said rotation angle measuring device and said surface height measuring device.

11. A recording apparatus according to claim 7, wherein said recording means comprises an ink-jet recording head for forming an image by discharging ink.

12. A recording apparatus according to claim 11, wherein said ink-jet recording head records an image with ink liquid droplets formed by heat energy.

13. A recording apparatus for performing recording onto a recording medium by recording means, said apparatus comprising:

transporting means for transporting the recording medium, said transporting means comprising a combination of driving elements including a transporting motor and a transporting roller, set so that the other driving elements are reset to an initial state upon completion of a turn of said transporting roller;

a detecting section, arranged on said transporting roller, showing a reference position of said transporting roller;

a reference position detector detecting said detecting section and outputting a detection signal;

a rotation angle measuring device attaching/detaching section, arranged on said transporting roller and being capable of attaching/detaching a rotation angle measuring device, measuring a rotation angle of said transporting roller;

a storage unit previously storing the number of driving pulses for a turn of the transporting roller, corrected so as to provide a constant amount of transportation of said transporting roller, on the basis of information from the rotation angle measuring device; and a controller driving-controlling said transporting motor on the basis of the corrected number of driving pulses stored in said storage unit.

14. A recording apparatus according to claim 13, wherein said transporting motor is a stepping motor.

15. A recording apparatus according to claim 13, wherein said driving elements, including said transporting motor and said transporting roller, include a positioning device primarily determining a rotating position of reference position detector of said transporting roller.

16. A recording apparatus according to claim 13, further comprising an adjusting system automatically performing a step of previously storing in said storage unit a number of driving pulses for a turn of said transporting roller, corrected so as to provide a constant amount of transportation of said transporting roller, on the basis of the information from the rotation angle measuring device.

17. A recording apparatus according to claim 13, wherein said recording means comprises an ink-jet recording head for forming an image by discharging ink.

18. A recording apparatus according to claim 13, wherein said ink-jet recording head records an image by means of ink liquid droplets formed by heat energy.

19. A recording apparatus for performing recording onto a recording medium by recording means, said apparatus comprising:

transporting means for transporting the recording medium, said transporting means comprising a combination of driving elements including a transporting motor and a transporting roller, and set so that the other driving elements are reset to an initial state upon completion of a turn of said transporting roller;

a detecting section, arranged on said transporting roller, showing a reference position of said transporting roller;

a reference position detector detecting said detecting section and outputting a detection signal;

a rotation angle measuring device attaching/detaching section, arranged on said transporting roller and being capable of attaching/detaching a rotation angle measuring device, the rotation angle measuring device measuring a rotation angle of said transporting roller;

a surface height measuring device attaching/detaching section, arranged on said transporting roller and being capable of attaching/detaching a surface height measuring device, the surface height measuring device measuring the surface height of said transporting roller;

a storage unit previously storing a number of driving pulses for a turn of said transporting roller, corrected so as to provide a constant amount of transportation of said transporting roller, on the basis of information from the rotation angle measuring device and the surface height measuring device; and a controller driving-controlling said transporting motor on the basis of the corrected number of driving pulses stored in said storage unit.

20. A recording apparatus according to claim 19, wherein said transporting motor is a stepping motor.

21. A recording apparatus according to claim 19, wherein said driving elements, including said transporting motor and said transporting roller, include a positioning device primarily determining a rotating position of the reference position detecting means of said transporting roller.

22. A recording apparatus according to claim 19, further comprising an adjusting system automatically performing a step of previously storing in said storage unit a number of driving pulses for a turn of said transporting roller, corrected so as to provide a constant amount of transportation of said transporting roller on the basis of the information from the rotation angle measuring device and the surface height measuring device.

23. A recording apparatus according to claim 19, wherein said recording means comprises an ink-jet recording head for forming an image by discharging ink.

24. A recording apparatus according to claim 23, wherein said ink-jet recording head records an image by means of ink liquid droplets formed by heat energy.

* * * * *